US010088136B2

(12) United States Patent
Sonneman

(10) Patent No.: US 10,088,136 B2
(45) Date of Patent: Oct. 2, 2018

(54) METHOD AND APPARATUS FOR HANGING LIGHTING FIXTURES

(71) Applicant: Contemporary Visions, LLC, Larchmont, NY (US)

(72) Inventor: Robert A. Sonneman, Mamaroneck, NY (US)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 15/662,830

(22) Filed: Jul. 28, 2017

(65) Prior Publication Data

US 2017/0343196 A1 Nov. 30, 2017

Related U.S. Application Data

(63) Continuation of application No. 15/286,977, filed on Oct. 6, 2016, which is a continuation of application (Continued)

(51) Int. Cl.
*H01R 25/00* (2006.01)
*F21V 21/35* (2006.01)

(Continued)

(52) U.S. Cl.
CPC ..... *F21V 21/35* (2013.01); *F21S 8/061* (2013.01); *F21S 8/066* (2013.01); *F21V 21/008* (2013.01); *F21Y 2115/10* (2016.08)

(58) Field of Classification Search
CPC ..... F21V 17/00–17/005; F21V 17/02–17/08; F21V 17/10; F21V 17/102; F21V 17/104;

(Continued)

(56) References Cited

U.S. PATENT DOCUMENTS 2,292,395 A 8/1942 O'Brien
D217,785 S 6/1970 Wolff (Continued)

FOREIGN PATENT DOCUMENTS

CN 200 986 123 Y 12/2007
CN 205261379 U 5/2016

(Continued)

OTHER PUBLICATIONS

USPTO, Final Office Action dated Jun. 6, 2017 issued in corresponding U.S. Appl. No. 15/251,369.

(Continued)

*Primary Examiner* — Jun Yoo
(74) *Attorney, Agent, or Firm* — Gottlieb, Rackman & Reisman, P.C.

(57) ABSTRACT

A modular lighting system for providing light in various areas includes one or more canopies, a set of buses, a set of hangers for supporting the bars from canopies and, optionally other supports, a set of pendants with light emitting elements and a set of hangers for supporting the pendants from the bars. The bars include two segments with conductive rails disposed or imbedded in their inner surfaces. The hangers have one or two rods and bases shaped and sized for mounting on the bars with the rods contacting the conductive rails. The hangers and bars cooperate to allow the hangers to be placed anywhere along the bars. The pendants and hangers may be sized and shaped so that the pendants trapped the ends of the hangers forming a supporting mechanical interlock therebetween. Pendants can be hanged on the bars singly, or in clusters.

4 Claims, 30 Drawing Sheets

Related U.S. Application Data

No. 15/197,919, filed on Jun. 30, 2016, now Pat. No. 9,879,845.

(60) Provisional application No. 62/275,921, filed on Jan. 7, 2016.

(51) Int. Cl.
*F21S 8/06* (2006.01)
*F21V 21/008* (2006.01)
*F21Y 115/10* (2016.01)

(58) Field of Classification Search
CPC ..... F21V 17/12; F21V 17/14; F21V 17/18; F21V 19/00–19/003; F21V 21/00–21/049; F21V 21/08; F21V 21/088; F21V 21/0885; F21V 21/104–21/116; F21S 8/00; F21S 8/04–8/068; F21S 2/005
See application file for complete search history.

(56) References Cited

U.S. PATENT DOCUMENTS

| | | | |
|---|---|---|---|
| D222,748 | S | 12/1971 | Strianese |
| 3,716,031 | A | 2/1973 | Rowbury |
| 3,748,463 | A | 7/1973 | Trassinelli |
| 4,723,747 | A | 2/1988 | Karp |
| 4,758,935 | A | 7/1988 | Frassati et al. |
| 4,763,870 | A | 8/1988 | Wodlinger |
| D301,304 | S | 5/1989 | Will |
| D317,058 | S | 5/1991 | Sonneman |
| 5,025,355 | A | 6/1991 | Harwood |
| D320,465 | S | 10/1991 | Sonneman |
| 5,065,295 | A | 11/1991 | de la Haye et al. |
| 5,105,349 | A | 4/1992 | Falls |
| D360,046 | S | 7/1995 | Sugiura |
| 5,440,469 | A | 8/1995 | Gomes |
| 5,455,754 | A | 10/1995 | Hoffner |
| 5,584,576 | A | 12/1996 | Wei Hong |
| D392,407 | S | 3/1998 | Johnson et al. |
| 5,833,358 | A | 11/1998 | Patik |
| 6,135,615 | A | 10/2000 | Lee |
| 6,179,442 | B1 | 1/2001 | Schurle |
| 6,241,369 | B1 | 6/2001 | MacKiewicz |
| 6,244,733 | B1 | 6/2001 | Fong et al. |
| 6,341,979 | B1 | 1/2002 | Yamamoto |
| 6,409,524 | B1 | 6/2002 | Miller et al. |
| 6,489,748 | B1 | 12/2002 | Okamura |
| 6,659,623 | B2 | 12/2003 | Friend |
| 6,769,790 | B2 | 8/2004 | Fruhm |
| D507,374 | S | 7/2005 | Chen |
| 7,172,332 | B2 | 2/2007 | Mobarak et al. |
| 7,246,935 | B2 * | 7/2007 | Benghozi ..... H01R 25/142 362/147 |
| 7,397,384 | B1 | 7/2008 | MacKenzie, IV |
| 7,503,778 | B2 | 3/2009 | Lehman et al. |
| 7,507,005 | B1 | 3/2009 | Mier-Langner |
| 7,520,762 | B2 | 4/2009 | Lehman et al. |
| 7,520,763 | B1 * | 4/2009 | Buse ..... H01R 25/142 439/121 |
| D595,884 | S | 7/2009 | Liao |
| 7,563,000 | B2 | 7/2009 | Gierveld |
| 7,571,736 | B1 | 8/2009 | Chu |
| 7,654,834 | B1 | 2/2010 | Imier-Langner et al. |
| D611,169 | S | 3/2010 | Harder |
| D620,168 | S | 7/2010 | Sabernig |
| 7,794,132 | B2 | 9/2010 | Cunius |
| 7,798,824 | B2 | 9/2010 | Fong |
| 7,806,913 | B2 | 10/2010 | Fanger |
| D629,954 | S | 12/2010 | Compton |
| D632,423 | S | 2/2011 | Canfield |
| 7,955,125 | B1 | 6/2011 | Petrillo |
| D648,470 | S | 11/2011 | Rains |
| D649,692 | S | 11/2011 | Trzesniowski |
| 8,061,865 | B2 | 11/2011 | Piepgras et al. |
| 8,398,276 | B2 | 3/2013 | Pearson et al. |
| D680,673 | S | 4/2013 | Levine |
| D689,221 | S | 9/2013 | Isaac |
| 8,523,378 | B2 | 9/2013 | Schulzman |
| 8,584,412 | B2 | 11/2013 | Frecska et al. |
| 8,616,871 | B2 | 12/2013 | Galomb |
| 8,733,710 | B1 | 5/2014 | Suazo |
| 8,794,804 | B2 | 8/2014 | Verfuerth |
| 8,814,383 | B2 | 8/2014 | Bizzotto et al. |
| 8,840,319 | B2 | 9/2014 | Hogue |
| 8,967,573 | B2 | 3/2015 | Hemmer |
| D739,070 | S | 9/2015 | Wilson |
| 9,136,659 | B2 | 9/2015 | Fishman et al. |
| D747,636 | S | 1/2016 | Maher |
| 9,387,268 | B2 | 7/2016 | Farren |
| D765,296 | S | 8/2016 | Wei |
| 9,464,772 | B2 | 10/2016 | O'Brien et al. |
| 9,472,912 | B2 | 10/2016 | Schirmeier |
| D772,467 | S | 11/2016 | Sonneman |
| D772,475 | S | 11/2016 | Sonneman |
| D773,099 | S | 11/2016 | Sonneman |
| D773,101 | S | 11/2016 | Sonneman |
| D773,715 | S | 12/2016 | Sonneman |
| D773,719 | S | 12/2016 | Sonneman |
| D773,725 | S | 12/2016 | Sonneman |
| D775,397 | S | 12/2016 | Sonneman |
| D779,113 | S | 2/2017 | Sonneman |
| D779,437 | S | 2/2017 | Sonneman |
| D779,712 | S | 2/2017 | Sonneman |
| D779,713 | S | 2/2017 | Sonneman |
| D779,714 | S | 2/2017 | Sonneman |
| D779,715 | S | 2/2017 | Sonneman |
| D782,990 | S | 4/2017 | Sonneman |
| 9,739,460 | B2 | 8/2017 | Haubach |
| 9,765,954 | B2 | 9/2017 | Zaderej et al. |
| 2003/0031018 | A1 | 2/2003 | Bray et al. |
| 2003/0103347 | A1 | 6/2003 | Friend |
| 2004/0005798 | A1 | 1/2004 | Lin |
| 2004/0160767 | A1 | 8/2004 | Mobarak et al. |
| 2005/0207173 | A1 | 9/2005 | Benghozi |
| 2007/0053209 | A1 | 3/2007 | Uhler et al. |
| 2007/0115694 | A1 | 5/2007 | Mobarak et al. |
| 2007/0247845 | A1 | 10/2007 | Udo |
| 2008/0190043 | A1 | 8/2008 | Beckmann |
| 2009/0051292 | A1 | 2/2009 | Noh |
| 2009/0123994 | A1 | 5/2009 | Lafaye et al. |
| 2010/0271834 | A1 | 10/2010 | Muessli |
| 2010/0271847 | A1 | 10/2010 | Mobarak et al. |
| 2012/0257388 | A1 | 10/2012 | Bracher et al. |
| 2014/0226315 | A1 | 8/2014 | Nicieja et al. |
| 2015/0198311 | A1 | 7/2015 | O'Brien et al. |
| 2015/0316238 | A1 | 11/2015 | Guilmette |
| 2015/0338037 | A1 | 11/2015 | Wang et al. |
| 2016/0033098 | A1 | 2/2016 | Bergman et al. |
| 2017/0198892 | A1 | 7/2017 | Sonneman |

FOREIGN PATENT DOCUMENTS

| | | | |
|---|---|---|---|
| DE | 8708815 | U1 | 11/1987 |
| DE | 4414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |
| WO | 2016/150564 | A2 | 9/2016 |

OTHER PUBLICATIONS

USPTO, Final Office Action dated Sep. 7, 2017 issued in corresponding U.S. Appl. No. 15/287,897.

(56) References Cited

OTHER PUBLICATIONS

USPTO, Non-Final Office Action dated Sep. 27, 2017 issued in corresponding U.S. Appl. No. 15/407,085.
USPTO, Non-Final Office Action dated Aug. 18, 2017 issued in corresponding U.S. Appl. No. 15/584,171.
Office Action issued by the USPTO dated Jan. 13, 2017 in corresponding U.S. Appl. No. 15/251,369.
Office Action issued by the USPTO dated Mar. 3, 2017 in corresponding U.S. Appl. No. 15/255,289.
Office Action issued by the USPTO dated Mar. 7, 2017 in corresponding U.S. Appl. No. 15/287,897.
Office Action issued by the USPTO dated Feb. 10, 2017 in corresponding U.S. Appl. No. 15/286,977.
Office Action issued by the USPTO dated Mar. 1, 2017 in corresponding U.S. Appl. No. 15/378,207.
Office Action issued by USPTO dated Dec. 22, 2017 in corresponding parent U.S. Appl. No. 15/197,919.
Office Action issued by USPTO dated Apr. 5, 2017 in corresponding parent U.S. Appl. No. 15/197,919.
Extended European Search Report dated Jun. 26, 2017 issued in corresponding European Patent Application No. 171506868.8.
Non-Final Office Action dated Dec. 6, 2017 issued in corresponding U.S. Appl. No. 15/446,302.
Non-Final Office Action dated Dec. 22, 2017 issued in corresponding U.S. Appl. No. 15/584,171.
Final Office Action dated Dec. 29, 2017 issued in corresponding U.S. Appl. No. 15/287,897.
Non-Final Office Action dated Jan. 12, 2018 issued in corresponding U.S. Appl. No. 15/801,855.
Non-Final Office Action dated Jan. 11, 2018 issued in corresponding U.S. Appl. No. 15/801,893.
Non-Final Office Action dated Jan. 11, 2018 issued in corresponding U.S. Appl. No. 15/808,109.
EPO, Extended European Search Report dated Jan. 3, 2018 issued in corresponding European Patent Application No. 17200563.9.
EPO, Extended European Search Report dated Jan. 5, 2018 issued in corresponding European Patent Application No. 17200550.6.
Non-Final Office Action dated Jan. 17, 2018 issued in corresponding U.S. Appl. No. 15/427,217.
Extended European Search Report dated Mar. 27, 2018 issued in corresponding European Patent Application No. 17200553.0 filed Nov. 8, 2017.
Extended European Search Report dated Mar. 28, 2018 issued in corresponding European Patent Application No. 17200535.7 filed Nov. 8, 2017.
Extended European Search Report dated Mar. 28, 2018 issued in corresponding European Patent Application No. 17200541.5 filed Nov. 8, 2017.
Partial European Search Report dated Apr. 24, 2018 issued in corresponding European Patent Application No. 7200544.9 filed Nov. 8, 2017.
EPO, Extended European Search Report dated Aug. 7, 2018 issued in corresponding European Patent Application No. 17200544.9 filed Nov. 8, 2017.

* cited by examiner

FIG. 9D
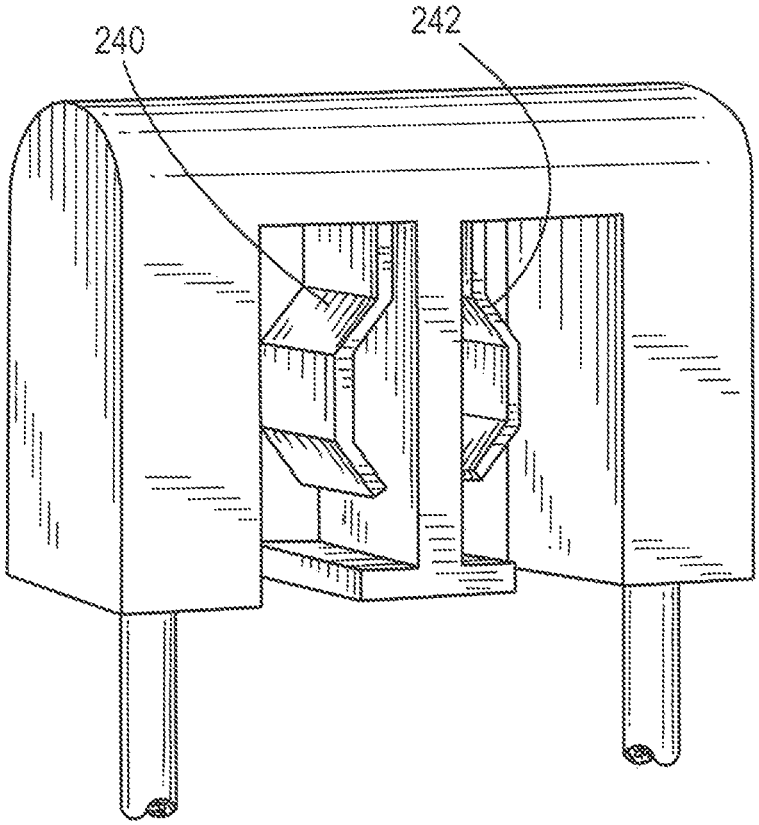
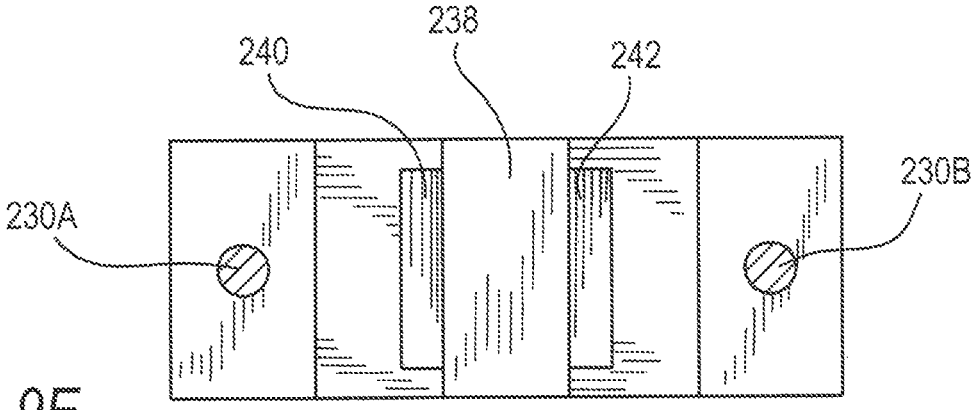
FIG. 9E

FIG. 9F
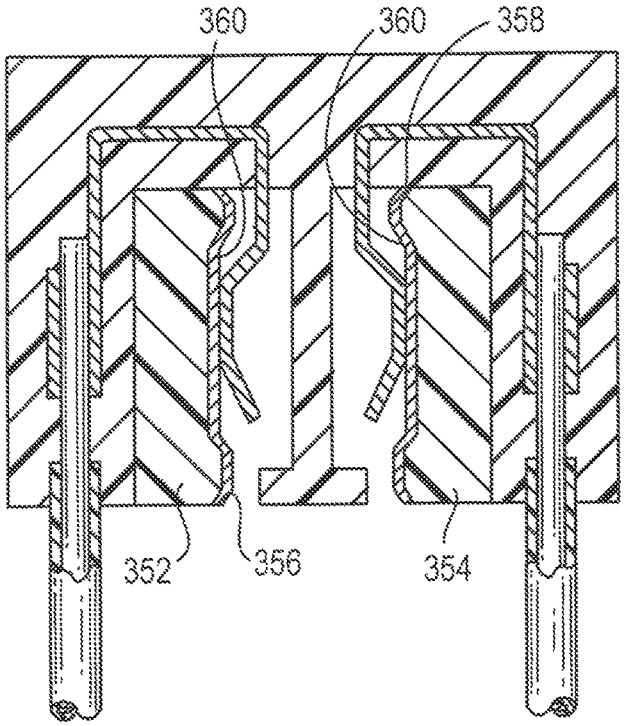
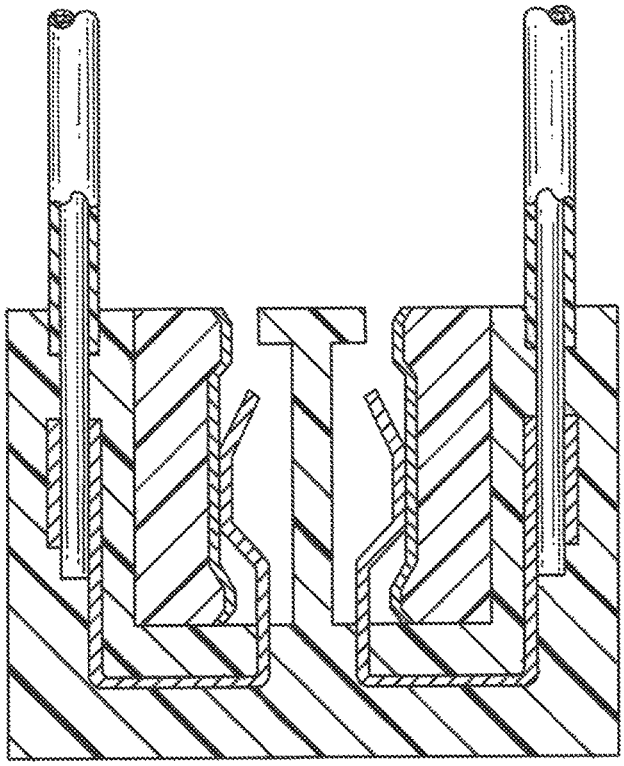
FIG. 9G

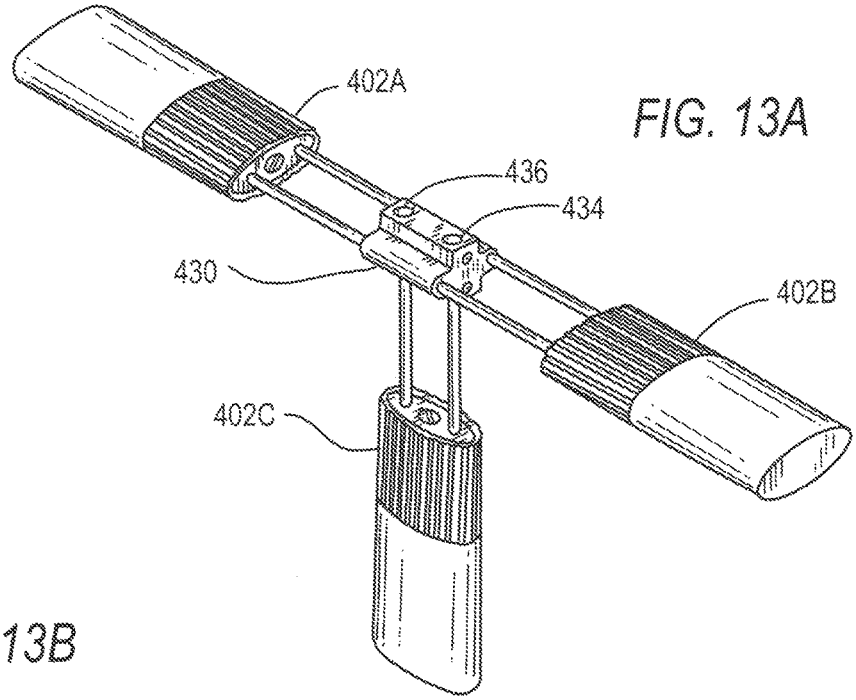
FIG. 13A
FIG. 13B
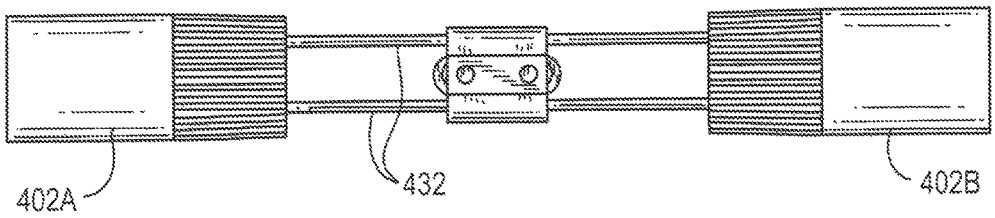
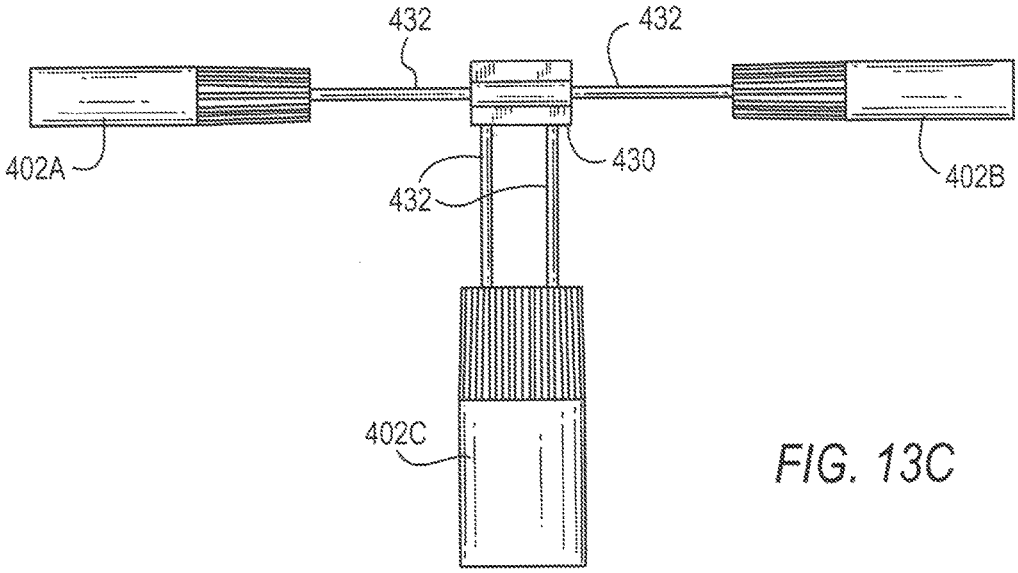
FIG. 13C

FIG. 14C
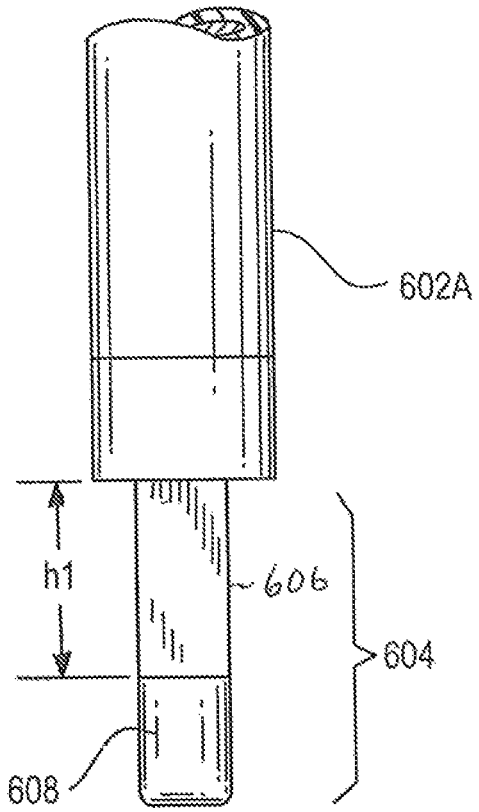
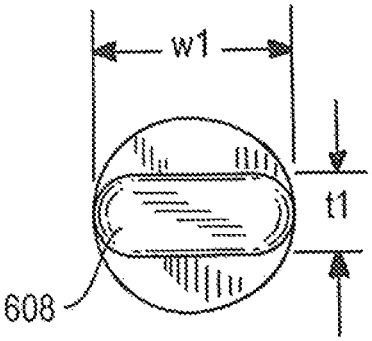
FIG. 14D

FIG. 14F
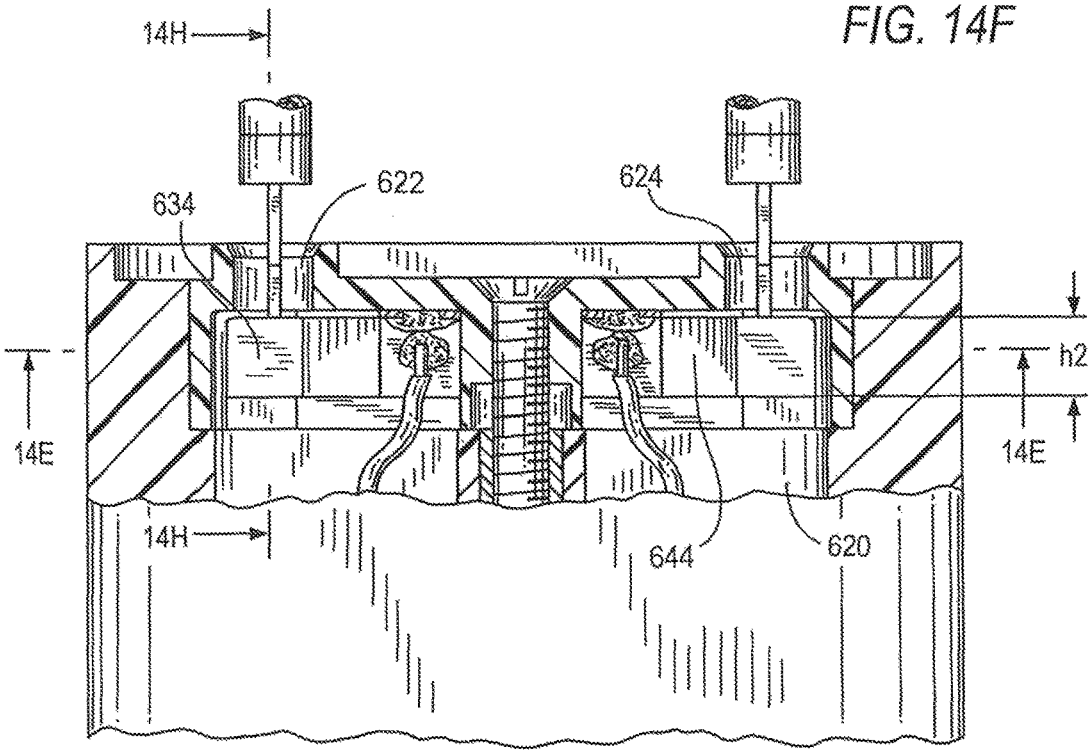
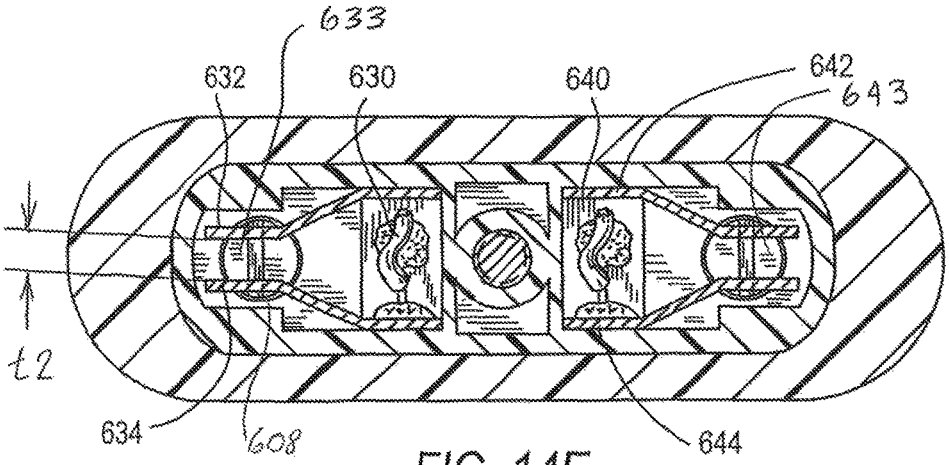
FIG. 14E

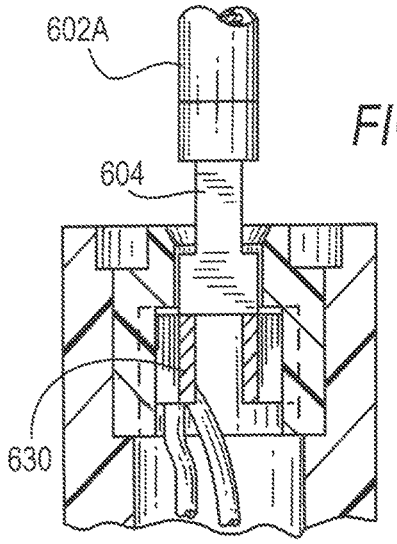
FIG. 14H
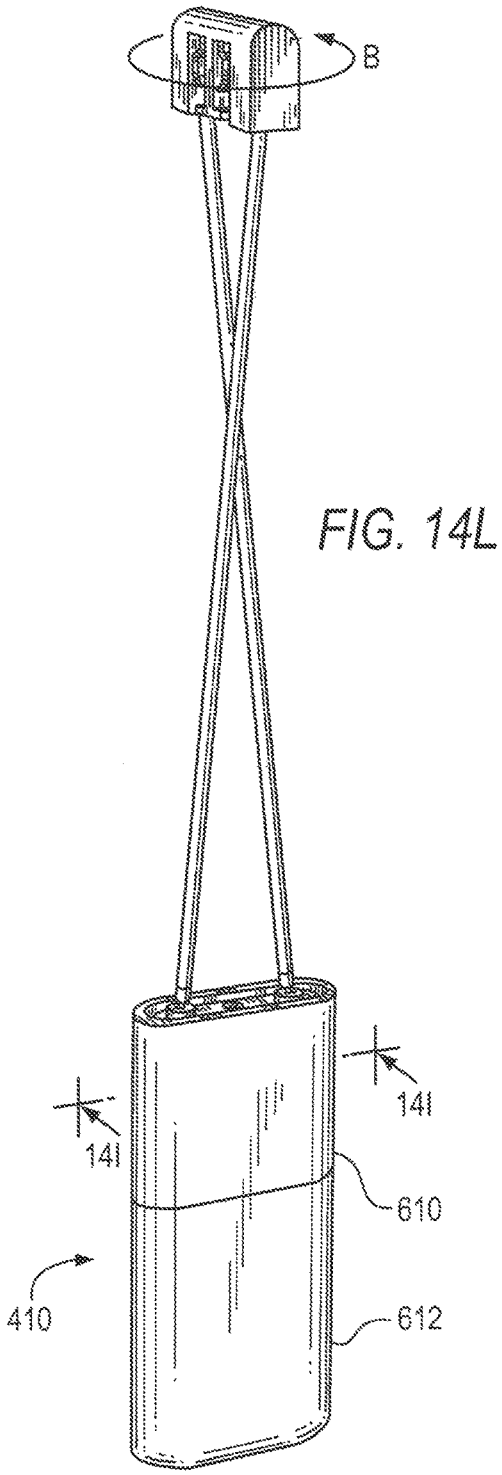
FIG. 14L
FIG. 14K
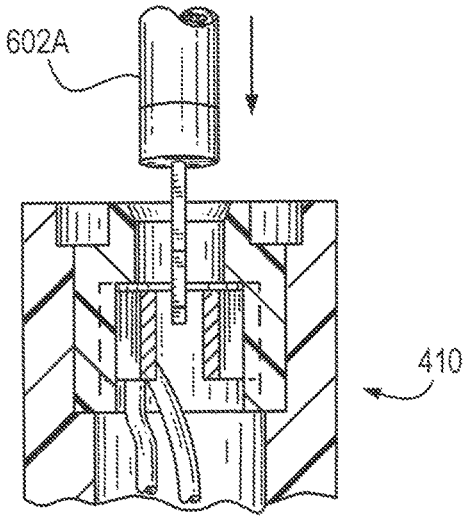

FIG. 14N
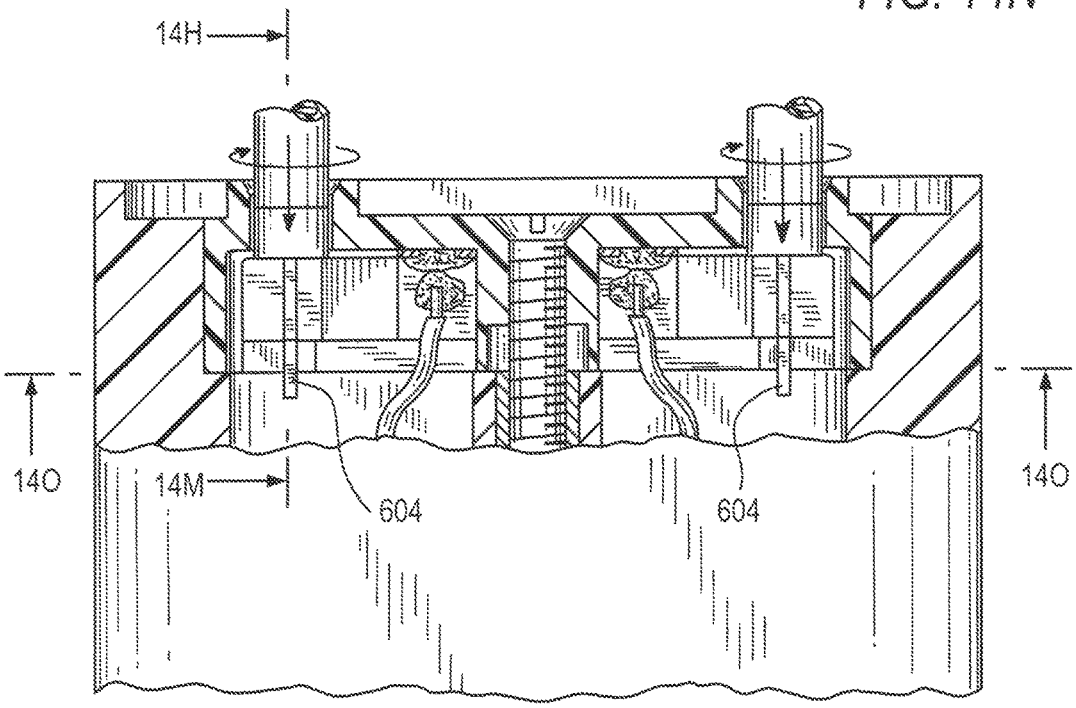
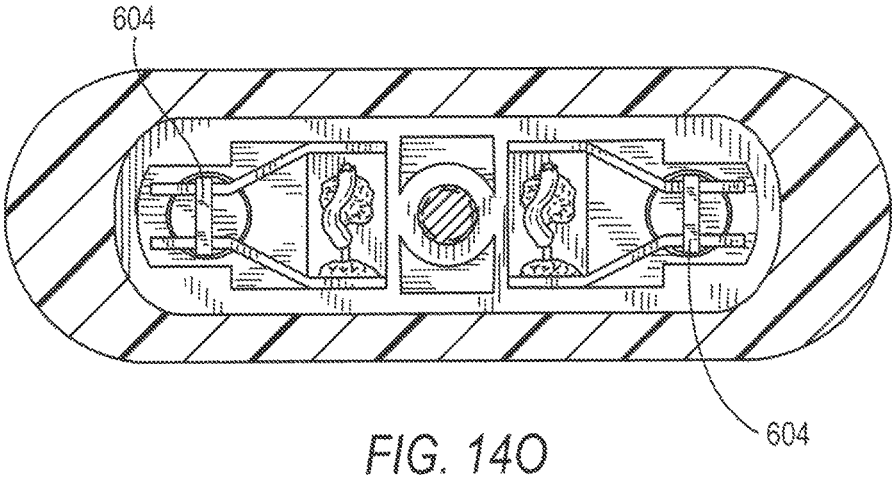
FIG. 14O

METHOD AND APPARATUS FOR HANGING LIGHTING FIXTURES

CROSS-REFERENCE TO RELATED APPLICATIONS

This application is a continuation application of U.S. patent application Ser. No. 15/286,977, filed Oct. 6, 2016, which in turn is a continuation application of U.S. patent application Ser. No. 15/197,919, filed Jun. 30, 2016 which claims priority to U.S. Provisional Application No. 62/275,921, filed Jan. 7, 2016, the contents of each of which are incorporated herein by reference in their entirety.

BACKGROUND OF THE INVENTION

A. Field of Invention

This invention pertains to a modular system having components that can be assembled to form multi-level lights of various sizes, shapes and configurations. More particularly, the system includes at least one hanger formed of two parallel rods with a bar connecting member on top for attaching hanger to a bar. The bottom parts of the rods are shaped so that the rods can be inserted into a pendant and form an interlock therewith.

B. Description of the Prior Art

Designing lighting for a space has always been an interesting challenge because the lighting equipment has to meet utilitarian, technical and esthetic needs. Thus, any such endeavor is successful only if combining technical, architectural and artistic skills.

Several different types of ceiling lights are presently available, including surface mounted lights, recessed lights and hanging lights disposed on tracks either attached to the ceiling or suspended below the ceiling. The first two light categories are very conventional and are disadvantageous because the positions of the lights are fixed and the configurations available for each light is very limited. Conventional track lighting provides a little more flexibility especially as far as the positions of the lights are concerned. However, because of power requirements and other factors, the number, size and shape of light fixtures that can be used in such systems is fairly limited.

SUMMARY OF THE INVENTION

Briefly, a modular lighting system for providing light in a space includes canopies connectable to a power source; a plurality of horizontal bars; a plurality of hangers, including a first set of hangers supporting bars from said canopy and a second set of hangers, each said hangers including a first end disposed between and engaging said bar segment. The system further includes a plurality of pendants supported by the second set of hangers from the bars. The hangers and bars cooperate to provide electric power to said pendants from said canopy.

Preferably, each bar includes two bar segments facing each other and being made of a non-conductive material. Conductive rails are provided on the inner surface of each bar segment. The hangers include a base configured to form an interference fit with the bar segments. In one embodiment, the hangers are made of conductive rods or cables that are in electrical contact with the rails through the respective bases.

In one embodiment, the bars are straight or linear. In another embodiment, the bars are circular or have some other curvilinear shape.

The bars preferably extend horizontally, however different bars are disposed at different heights and are supported from one or more canopies or straight from a ceiling by hangers of various configurations or cables.

Preferably, at least one of the canopies is connected to a line voltage and transformer is used to step down the line voltage to a lower voltage such as 24 vac which is then distributed to the pendants through the hangers and bars.

The pendants include light emitting elements such as LEDs, electronic circuitry for driving the LEDs, and are preferably shaped for heat dissipation. Since the LEDs have a long life, they are not replaceable but instead the whole pendant is replaced as needed.

These various elements are combined in many different ways resulting in a virtually infinite number of configurations. One class of configuration may include several bars disposed in a vertical plane. In another class of configurations, several bars extend at different angles in one plane, and are joined at a common point. Another class of configurations may include a combination of the first to classes. Another class of configurations may include several bars disposed at different heights or tiers, some bars being perpendicular to other bars.

Preferably at least hanger is provided with a top portion for engaging a bar and two vertical rods having spade shaped ends that cooperate with structures in a pendant to allow a strong positive interlock with the pendant. The rod ends are first inserted into holes in the pendant and then twisted around a vertical axis. This action causes the rod ends to twist as well and enter a respective gap in the pendant. Once the ends enter into the pendant past the gap, the hanger is released to its normal position causing the rods to twist back to their normal position. In this position, the rod ends are trapped within the pendant thereby providing interlocking support for the pendant. The pendant can be removed by reversing the operation.

BRIEF DESCRIPTION OF THE DRAWINGS

FIG. 9A-9J show details of a bar hanger used for interconnecting two bars in the embodiments of FIGS. 1-6;

FIGS. 13A-13C show a top, front and isometric view of a pendant cluster used in the embodiment of FIG. 1;

DETAILED DESCRIPTION OF THE INVENTION

Figure 1:
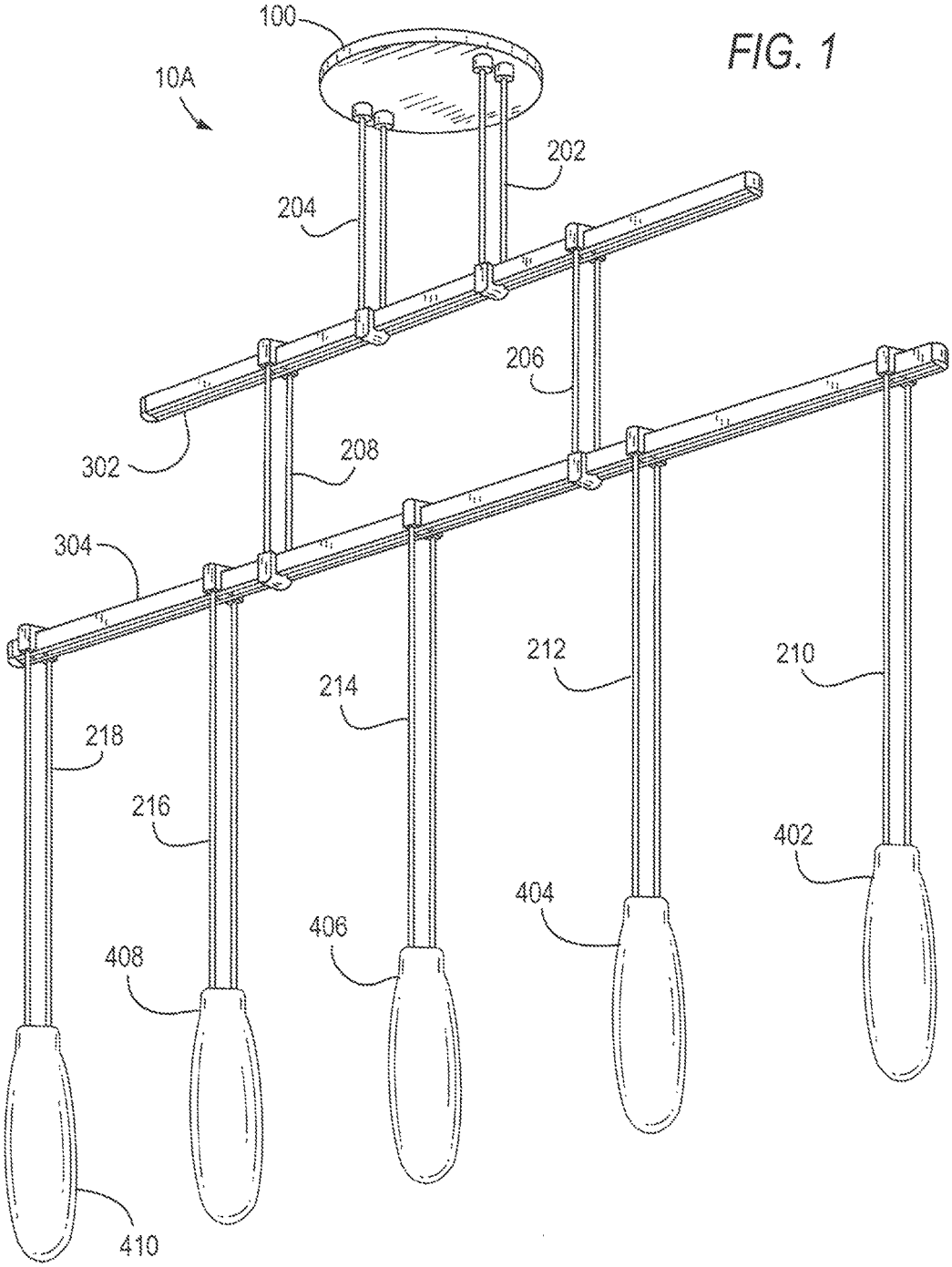
FIG. 1 shows an isometric view a modular lighting system constructed in accordance with this invention with two parallel bars suspended from a single canopy.

The present invention pertains to a modular lighting system having a plurality of interchangeable elements that can be combined in many different ways to obtain a large variety of configurations. FIGS. 1-6 show four such systems identified respectively as 10A, 10B, 10C, 10D, 10E and 10F. Generally speaking, each system includes one or more canopies 100, a plurality of hangers 200, a plurality of power bars 300 and a plurality of pendants 400. In addition, some systems may also include optional connectors 500. Unless otherwise noted, all the hangers and all power bars consist of two elements that have dual functions, they support the pendants 400 and they provide power to the pendants, with one elements forming the positive or hot power connection and the other element defining the negative or ground power connection.

For example, system 10 in the FIG. 1, system 10A includes a canopy 100 that supports the system from a ceiling or other similar architectural member in a conventional manner. In this case, the canopy also provides power to the system. Canopy 100 includes a conventional power supply connected to standard AC lines for providing power to the LED tubes in the pendants as discussed below. The power supply is hidden within the canopy.

Two hangers 202, 204 extend downwardly from the canopy. In one embodiment, each hanger discussed hereinafter consists of two solid bars or rods. These hangers are termed the power feed hangers. In an alternate embodiment the hangers are replaced by multi-strand twisted cables. As explained above, each hanger is formed of two elements (e.g., rods or cables). Preferably only two of the four elements (e.g., the rods of hanger 202) carry power and the other two elements are used for support.

The hangers 202, 204 are used to support a power bar 302. Two hangers 206, 208 are used to support a second power bar 304 and are termed bar hangers.

Another set of hangers 210-218 are used to support a plurality of pendants 402-410. These hangers are termed pendant hangers. The pendants 402-410 preferably include LED.

Included in canopy 100 is a transformer steps down the line voltage from a standard power line to 24 VAC for the pendants 402-410. The other hanger 204 may be electrically floating. The power from the hanger 202 flows through the bar segments of bar 302, hanger 206, bar 304 and hangers 210-212 to the pendants. Thus, in this embodiment, only some of the pendants carry power but all the power bars do.

Figure 2:
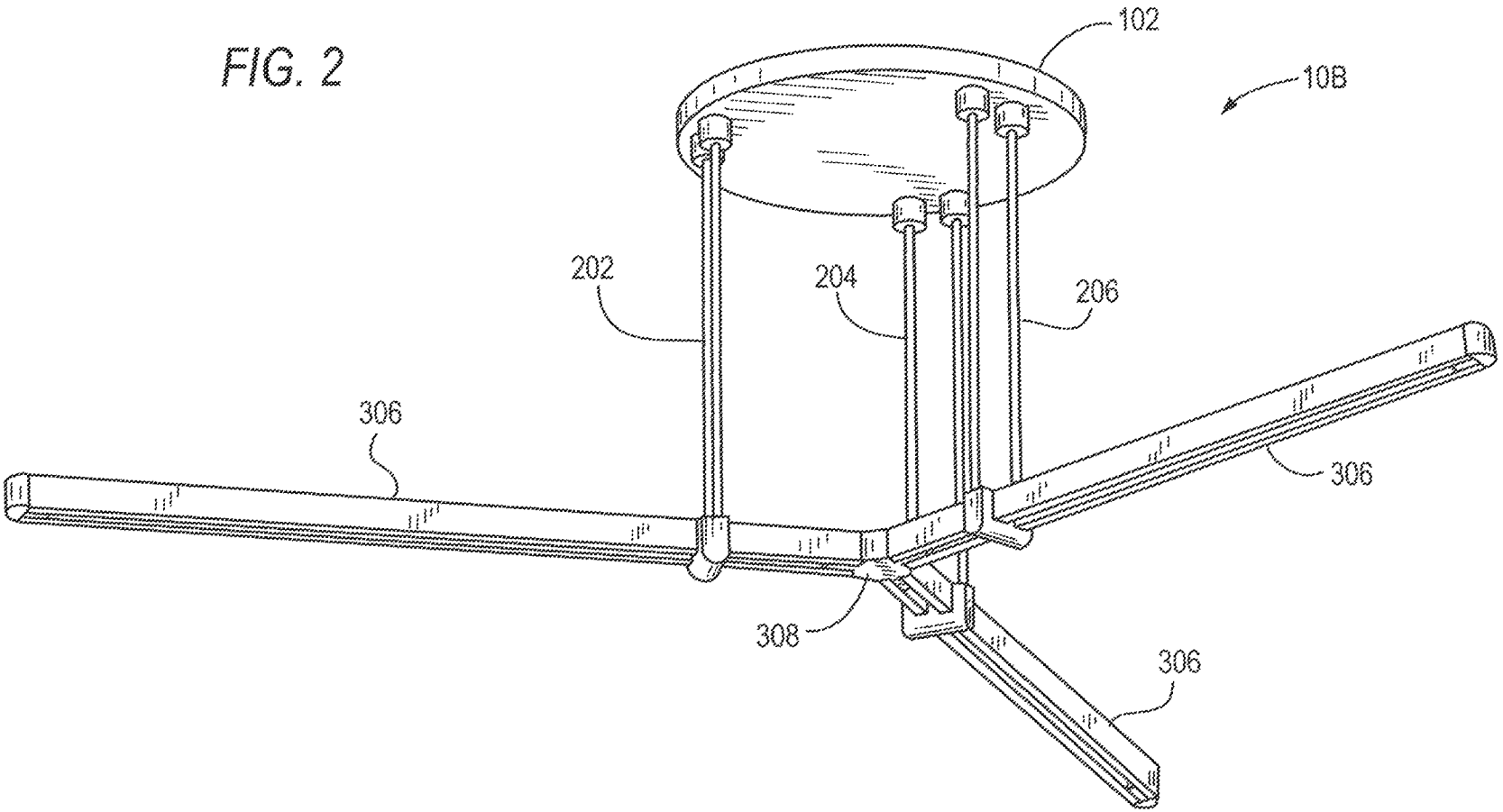
FIG. 2 shows an isometric view of another embodiment with bars disposed at an angle with each other in a single tier and suspended from a single canopy.

FIG. 2 shows a system 10B in which three bars 306 are connected at a common connector 308 that keeps the bars at a specific angle with respect to each other to form a Y-shaped arrangement. This angle could be 120°, 45°, 135°, etc. and the bars may but need not be disposed at a constant angle between each other. Bars 306 are supported by respective hangers 202, 204, 206 from the canopy 102 as shown. The pendants and hangers supporting them have been omitted in this figure for the sake of simplicity.

Figure 3:
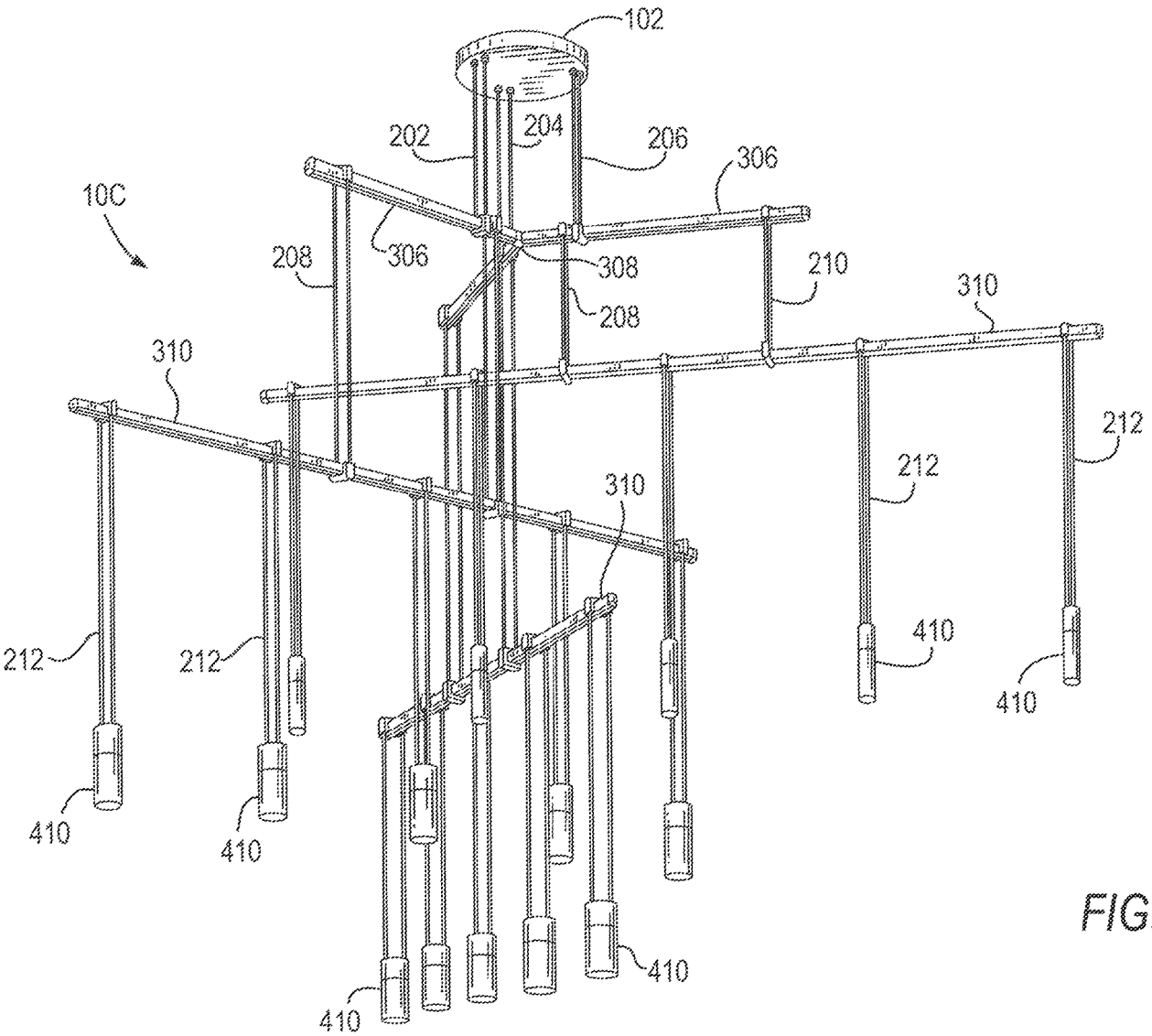
FIG. 3 shows an isometric view of another embodiment of the invention in which six bars disposed at various tiers and angles are suspended from a single canopy.

FIG. 3 shows a system 10C with pendants arranged at several levels and extending in different directions from a central point below the canopy 102. This is achieved by starting with a Y-shaped bar arrangement of FIG. 2 formed again of three bars 306 supported by hangers 202, 204, 206 and joined by a connector 308. However, in this case, each bar 306 is used to support another bar 310, each bar 310 being supported by a pair of hangers 208, 210. Hanging from each bar 310 are a plurality of pendants 410 supported by hangers 212. All of pendants 410 supported by the same bar 310 can be disposed at different height, or different hangers may be disposed at different heights.

Figure 4:
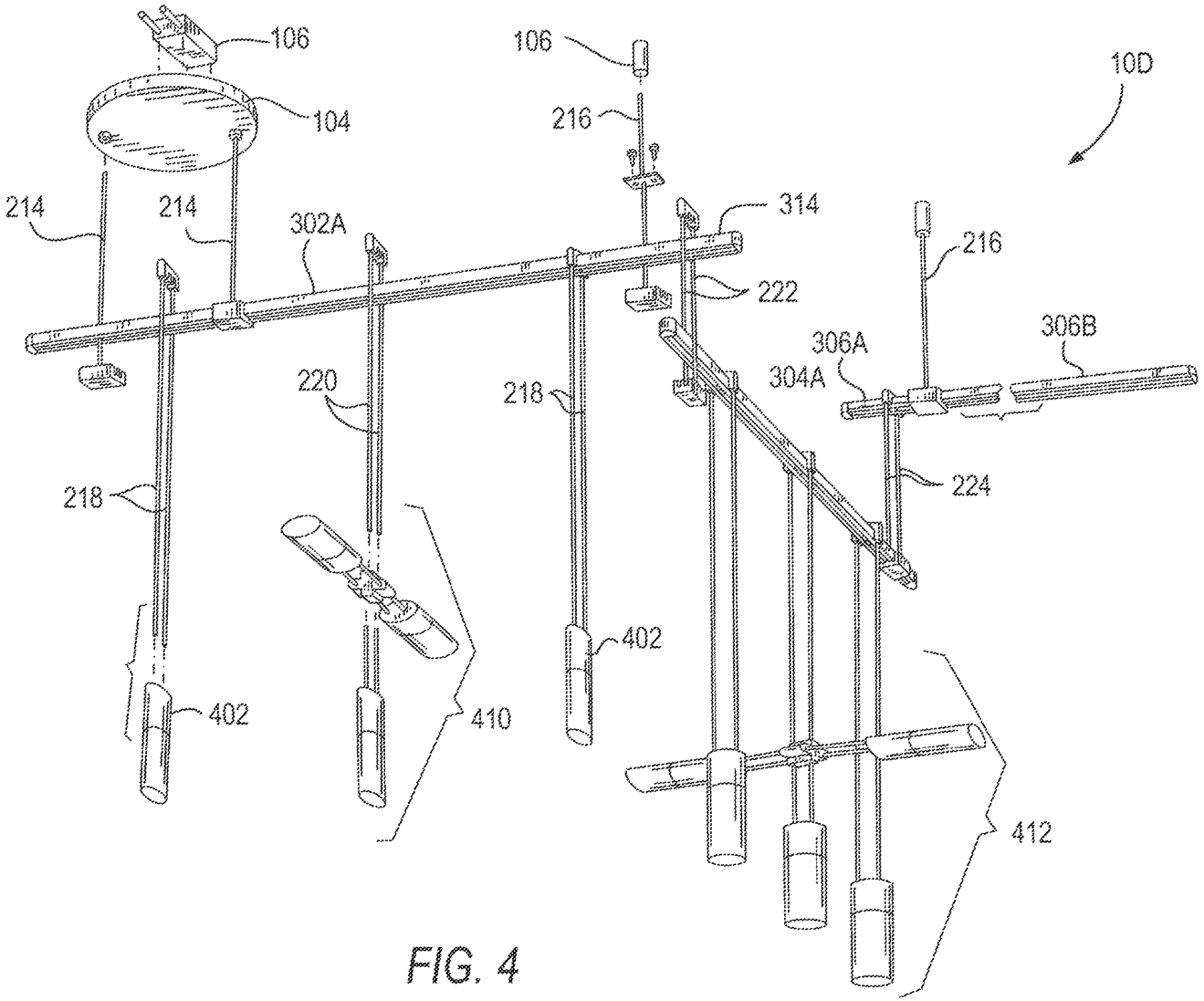
FIG. 4 shows an isometric view of another embodiment of the invention in which several different bars are disposed at right angle and are supported by a canopy and other ceiling supports.

FIG. 4 shows yet another system 10D. This system 10D includes a canopy 104 with a transformer 106. Attached to the canopy 104 is a first bar 302A using two hangers 214. As opposed to the hangers discussed previously, hangers 214 have a single extended element, such as bar, as described in more detail later. Each of the hangers 214 provides power to one of the elements of bar 302A. However because the bar 302A is not centered below the canopy 104 but extends in one direction away therefrom, another hanger 216, which may be referred to as a ceiling hanger, is used to support a distal end 314 of bar 302. At its top, hanger 216 is attached to a sleeve 106 secured to the ceiling in a conventional manner.

Hangers 218 are used to attach respective pendants 402 from bus 302. Another hanger 220 is used to support a cluster of pendants 410.

A second bar 304A is also provided. This bar 304A is supported at one end by a hanger 222 from bar 302A. This hanger 222 also provides power to bar 304A. A third bar 306 is also provided that is supported from the ceiling by ceiling hangers 216 (only one such ceiling hanger is being shown for the sake of clarity). Bar 306 supports the second end of bar 304A and receives power from said bus 304 through hanger 224. Each of the bars 302A, 304A, 306 can be used to hang pendants of various sizes and shapes and arranged in different configurations as desired.

Figure 5:
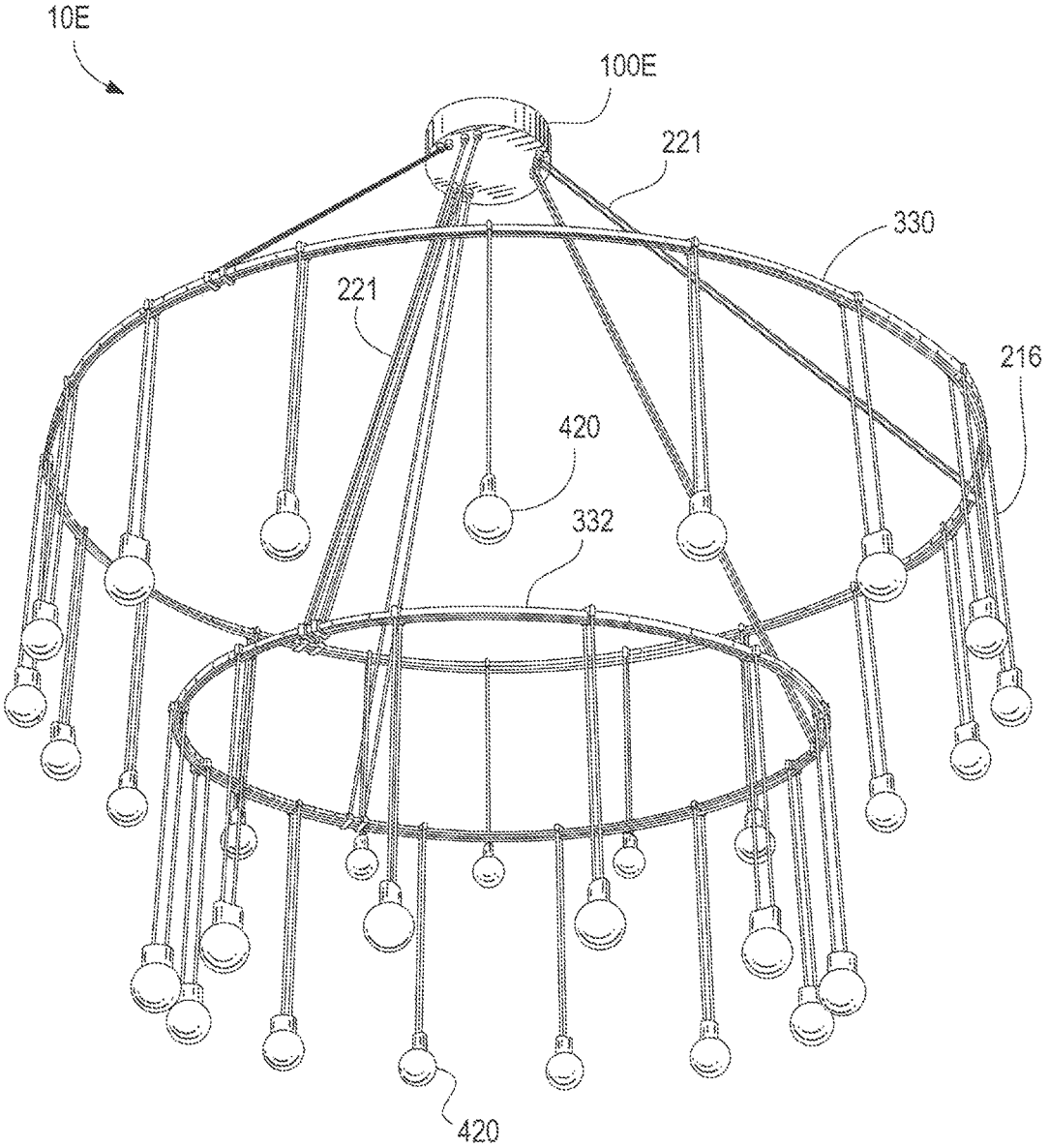
FIG. 5 shows an isometric view another embodiment of the invention in which two circular bars are disposed at different tiers and supported by a single canopy.

FIG. 5 shows another system 10E having a canopy 100E supporting two ring-shaped, rather than rectilinear bars 330, 332 arranged at two levels and with various shapes and types of pendants 420 extending downwardly from the respective bars 330, 332, each being supported and powered by a respective hanger 218. Since the diameters of the ring-shaped bars 330, 332 are larger than the diameter of the canopy 100E, rods or cables 221.

Figure 6:
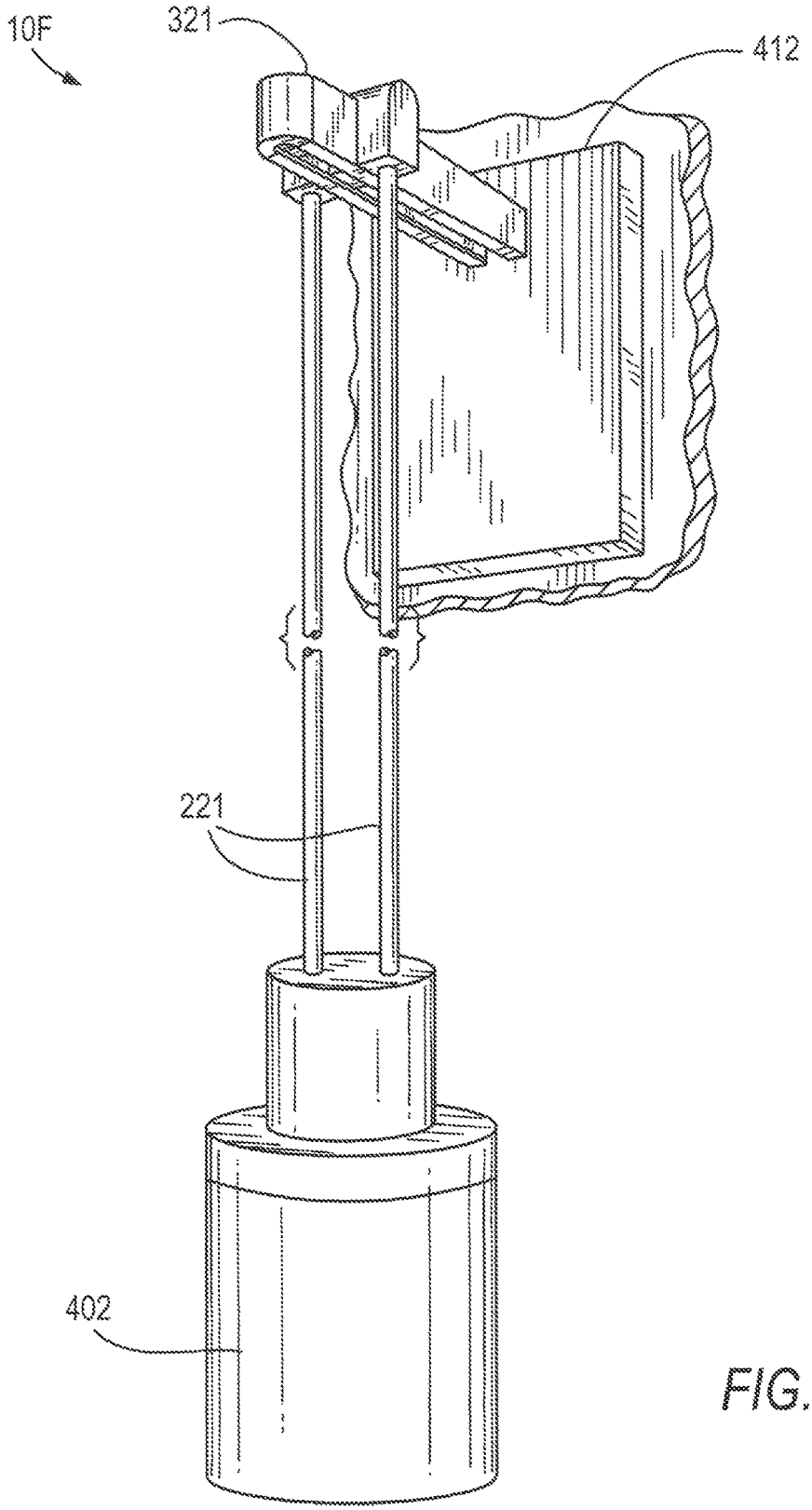
FIG. 6 shows another embodiment of the invention in which a single bar disposed at a right angle with respect to wall and supported by a wall-mounted canopy.

FIG. 6 shows a wall-mounted system 10F with a wall mounted canopy 112. A horizontal bar 321 attached directly to and extending away from the canopy 112 provides power and supports a pendant 402 via a hanger 221. Alternately, other horizontal bars may be supported from bar 321 for hanging various pendants (not shown).

Figures 7A, 7B, 7C, 7D, 7E:
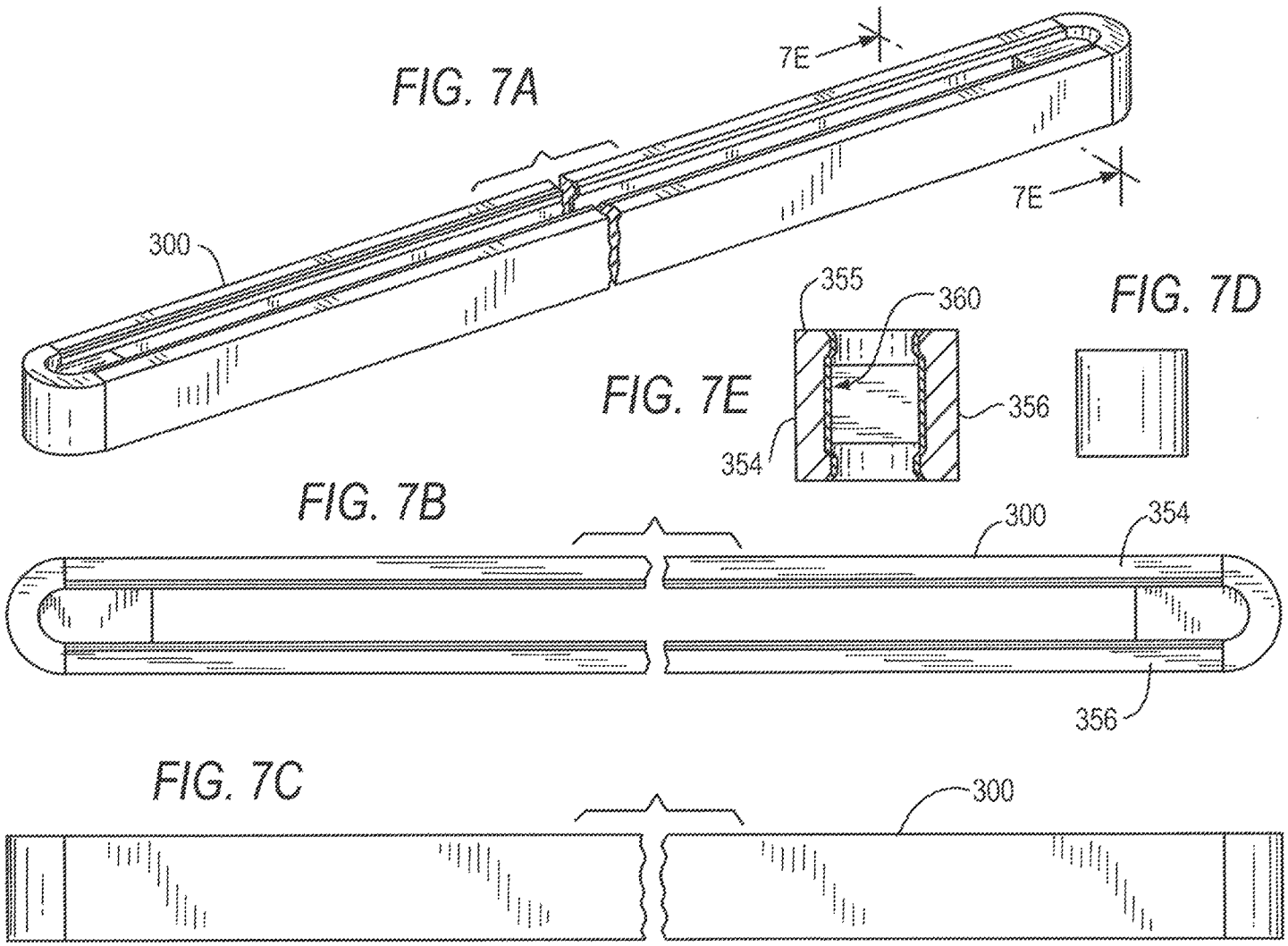
FIGS. 7A-7K show an isometric and a cross-sectional view of a bar used in the embodiments of FIGS. 1-6.
Figures 7F, 7G, 7H, 7I, 7J, 7K:
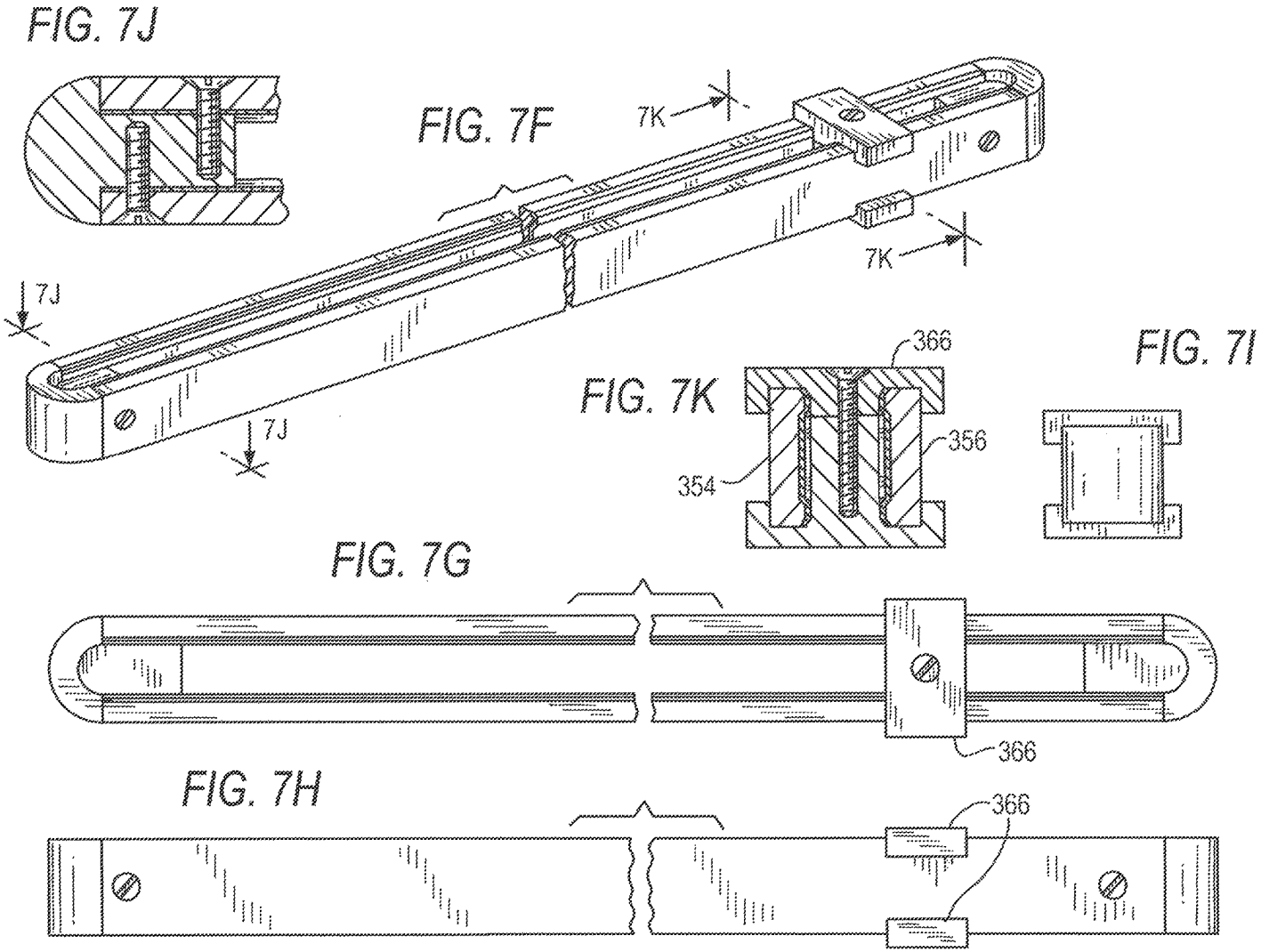
Figure 7L:
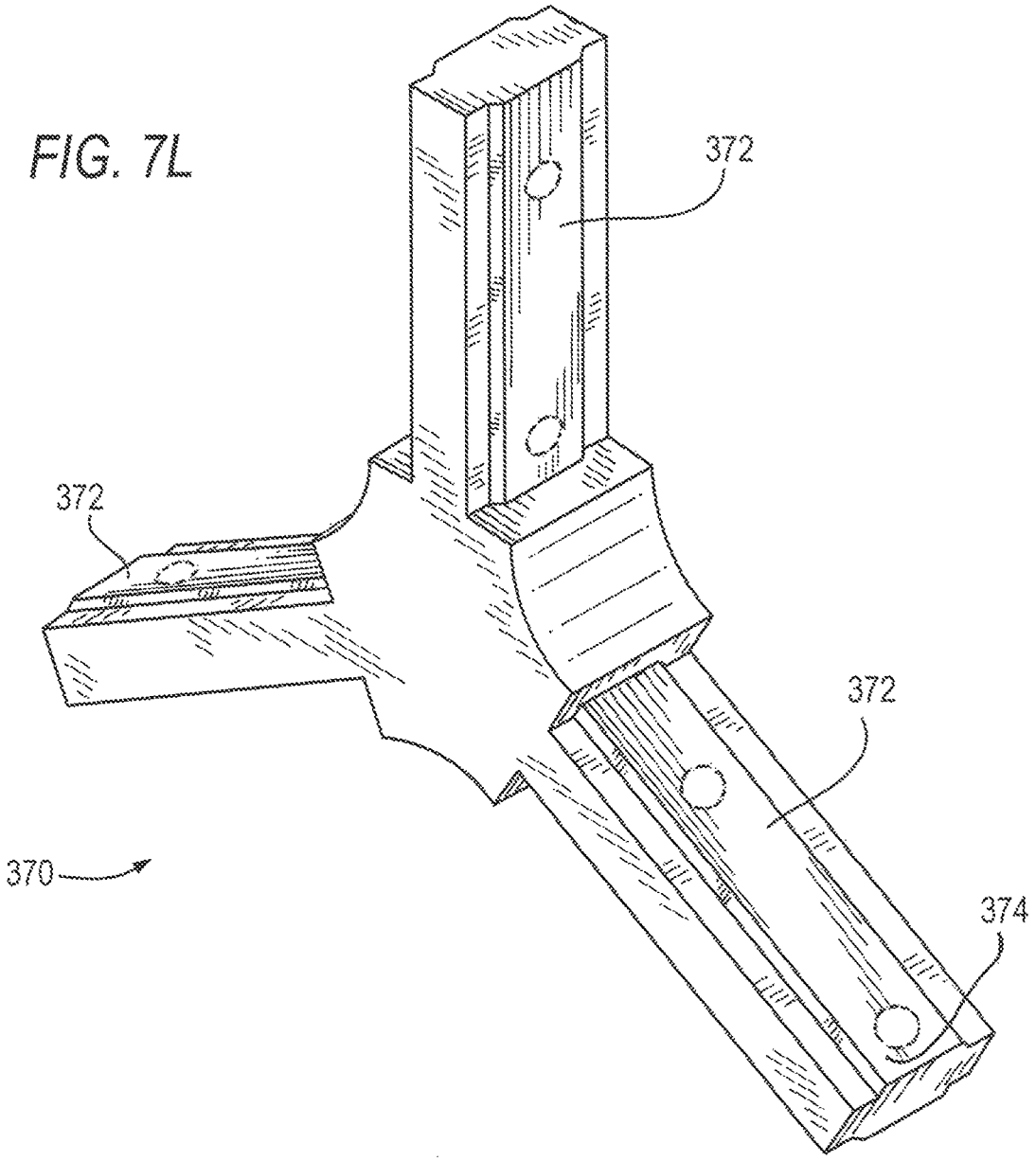
FIG. 7L shows an isometric view of a connector used to connect three bars in the embodiments of FIGS. 2 and 3.

Details of a generic bar 300 are shown in FIGS. 7A-7K. Unless otherwise noted, all the bars discussed here have the same configuration. In this Figure, bar 300 is shown as being straight however, it can be circular ellipsoid or can have other geometric shape. The bar 300 includes two identical longitudinal segments 352, 354 facing each other. A cross-sectional view of segment 354 is seen in FIG. 7B. Segment 354 is formed of a C-shaped main body 355 made of a non-conductive material, such as a plastic material that is light weight but strong so that it can support various pendants, other bars, etc. Imbedded in this main body 355 is a rail 356 made of a light weight conductive material such as aluminum. Preferably rail 356 is formed with a rectangular channel 360. The two segments 352, 354 are joined together at the two ends by end connectors 362. The connectors 362 are attached to the bars by conventional means, such as screws 364, by an adhesive or other means.

Preferably, the two segments 352, 354 have inner surfaces spaced at a nominal distance d throughout the length of the bar 300. The bar 300 is made in standard lengths ranging from to 12 to 48 inches. For very long bars, for example in excess of 24 inches, a spacer 366 is placed between the segments. The spacer 366 may be held in place by screws or other means.

FIG. 7C shows details of a connector 370 used to connect three bars, for example for the systems of FIGS. 2 and 3. The connector 370 is formed of three arms 372 disposed at an angle of 120 degrees. The inner surfaces of the arms 372 are provided with rails 374 having the size and shape to fit into the channels of the rails of bars 300. Three bars having the same, or different length are attached telescopically to the connector 370.

Figure 8A:
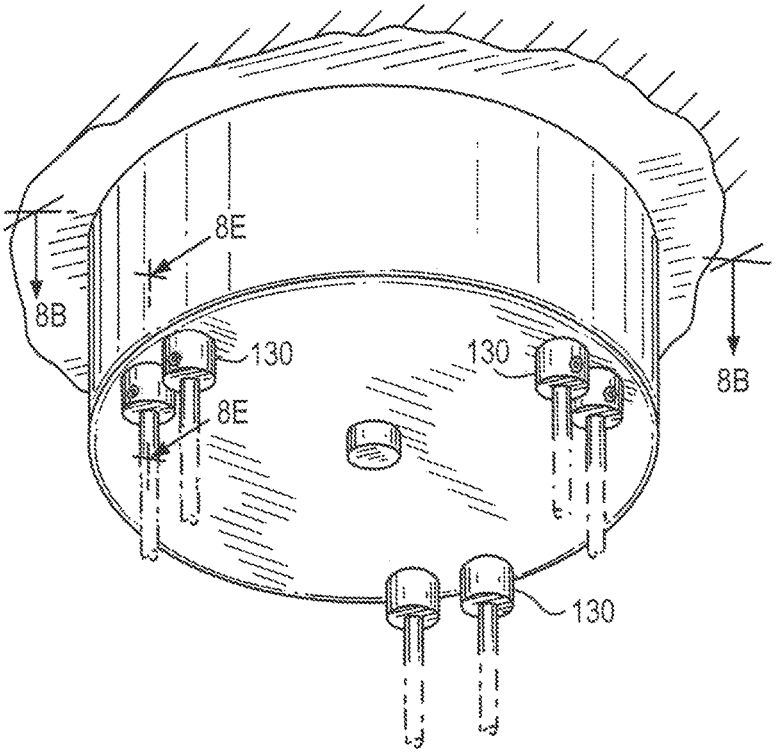
FIGS. 8A-8E show details of a canopy used in the embodiments of FIGS. 1-6.
Figure 8E:
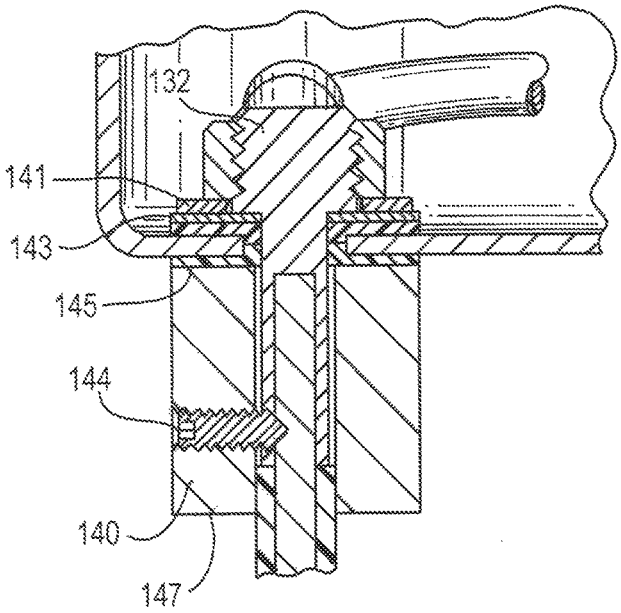
Figure 8B:
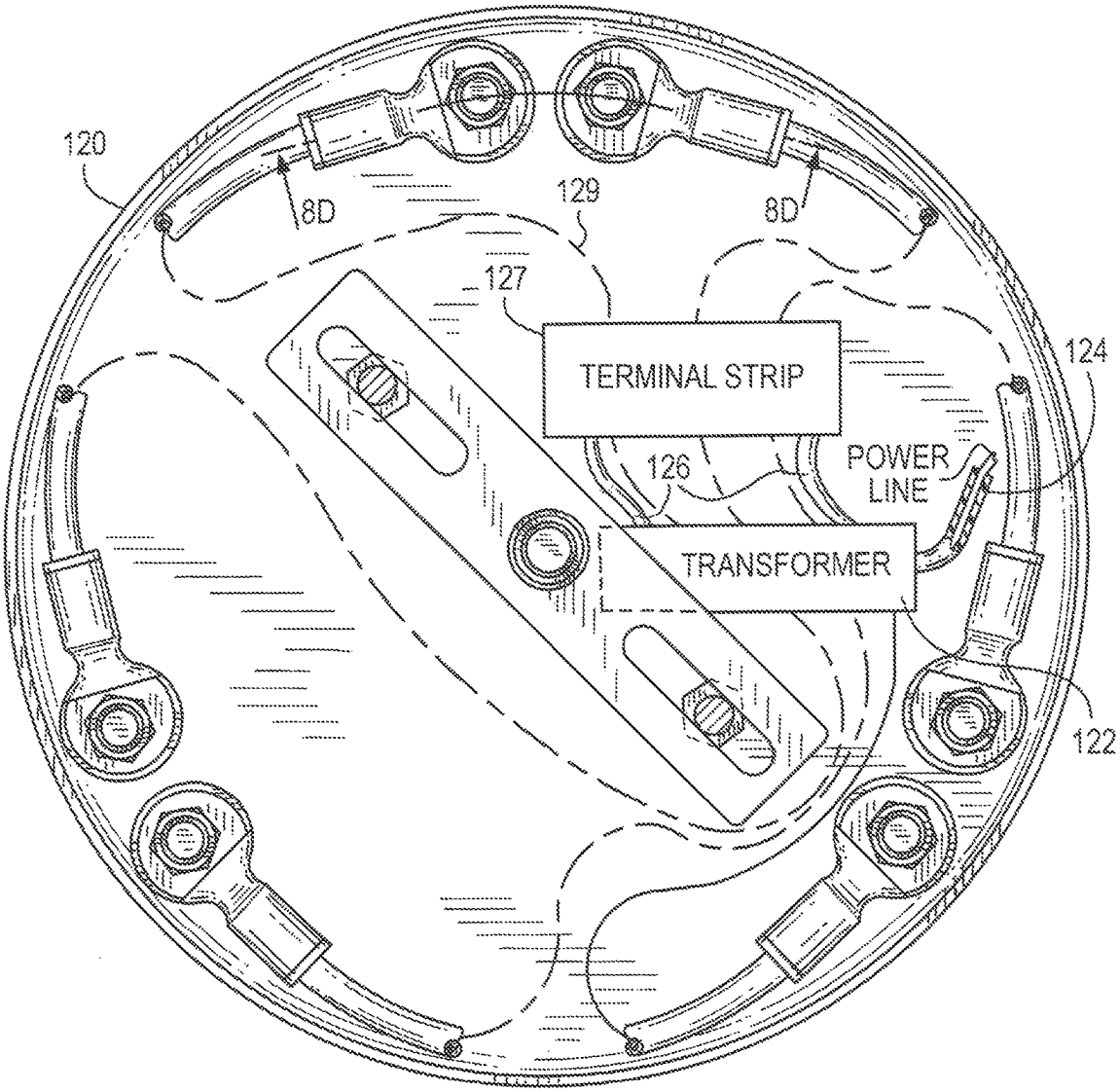
Figure 8C:
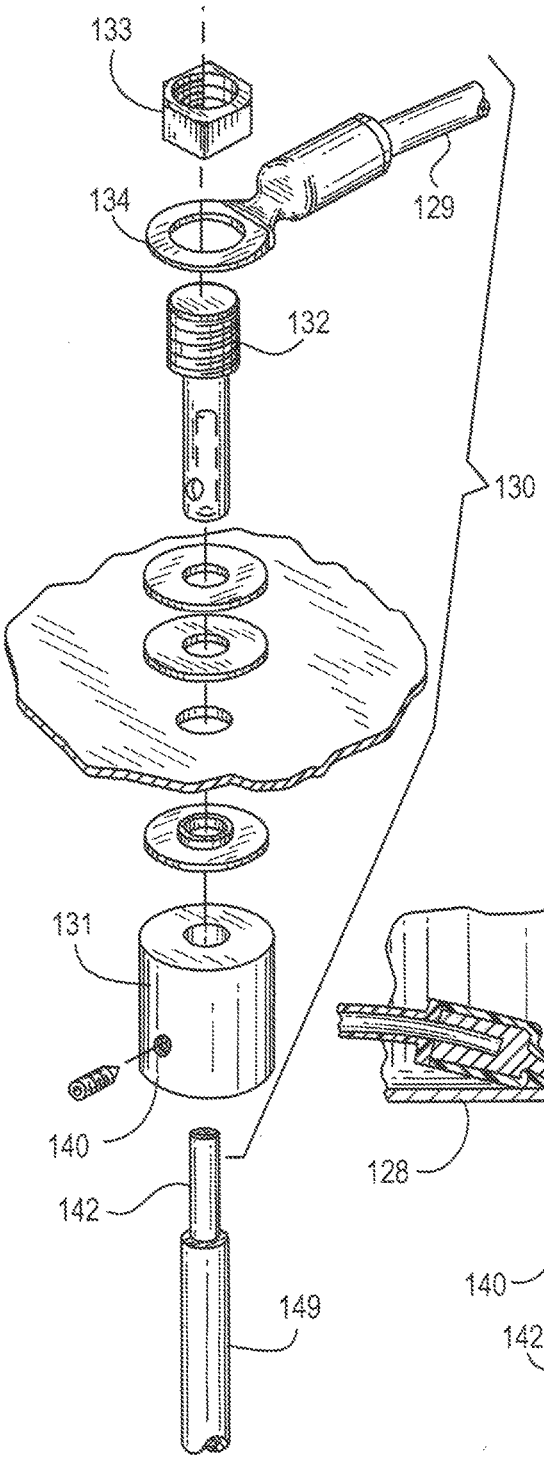

Details of a typical canopy 100 are shown in FIGS. 8A-8C. Each canopy 100 includes a cup-shaped housing 120 that can be cylindrical, square, and rectangular, etc. The housing 120 holds a transformer 122 receiving power from line wires 124 and outputting power at a lower voltage on output wires 126. The output wires 126 are connected to a terminal strip 127 used to be distributed the low ac voltage power through a plurality of lines 129. As will be discussed in more detail below, preferably transformer 122 outputs power at about 24 vac. On its bottom surface 128, the housing 120 is provided with a plurality of ferrules 130. Depending on the exact required configuration, these ferrules 130 may be arranged single or in pairs, and a canopy may be provided with two four, six, eight ferrules, etc. Some of the ferrules provide power to the respective hangers or cables and also provide structural support. Other ferrules do not provide power but merely provide structural support.

As shown in FIGS. 8C and 8E, each conducting ferrule 130 terminates in a threaded bolt 132. An eyelet 134 is attached to each bolt 132 using a threaded nut 133 or other conventional means. Each eyelet is connected to one of the output wires 129.

Figure 8D:
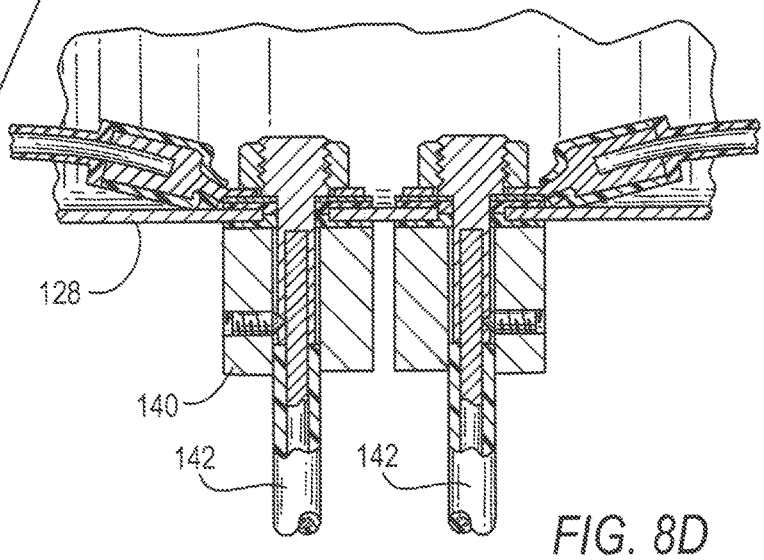

As seen in FIGS. 8C, 8D and 8E, each ferule 130 further includes cylindrical sleeve 140 with a ferule body 147 attached to bolt 132 and extending through the housing 120 and below surface 128. The sleeve 140 is electrically insulated from the housing 120 and receives the conductive end of a rod 142 forming a part of a hanger as described below or a cable. A set screw 144 is used to secure the rod 142 in the sleeve 140. A washer 139 is disposed below nut 133 and is insulated from the housing 120 by an insulating disc 143. A second insulating disc 145 is disposed above the ferule body 147 to insulate it from the housing 120 as well. The rod 142 is preferably covered with an insulator 149.

The non-conductive ferrules have a similar configuration but are not connected to any output wires 126. The ferrules receive rods similar to rod 142 but these latter rods do not provide power.

There are several different types of bar hangers are provided: hangers for supporting bars from canopies, hangers for supporting bars from ceilings (without a power connection), hangers for supporting one bar from another bar and hangers for supporting pendants. All these hangers have must be able to interface with a bar at least at one end as described below.

There are two types bar-to-bar hangers: parallel hangers for connecting two parallel bars and perpendicular hangers connecting two bars running perpendicular two each other.

FIGS. 9A-9G show details of parallel bar hanger such as hanger 206 supporting bar 304 from bar 302 in FIG. 1. The hanger 206 includes two vertical segments 230A, 230B. At the top and the bottom, the two segments 230A, 230B have their ends imbedded in identical W-shaped bases 232, shown in more detail in FIGS. 9B-9E. The base 232 forms two channels 234, 236 with a wall 238 separating the two channels. The base 232 is further formed with two metallic springs or clips 240, 242. Clip 240 is electrically attached to segment 230A within the base 232, and clip 242 is connected to segment 230B. Preferably, base 232 is made of a non-conductive material and is overmolded to cover portions of the clips 240, 242 and segments 230A, 230B. In one embodiment, the two bases 232 have a single, unitary structure. In another embodiment, at least the top base is made of two sections 232A, 232B that snap together along line 232 forming an interference fit therebetween.

As can be seen in FIGS. 9F and 9G, the bases 232 as sized and shaped so that they fit over and engage the bars 302, 304. Importantly, the clips 240, 242 are sized and shaped so that they engage the rails 356, 358. The clips 240, 242 have a flat section 244 sized and shaped to snap into the channels 356, 358 of the bars 302, 304. In this manner not only do the clips 240, 242 provide a solid electrical contact with the rails 356, 358 but they also stabilize the hangers on the bars and insure that the lower bar 304 remains stiff and does move around in use. The clips may be made from beryllium copper.

Hanger 208 has a similar configuration however the clips need not be connected electrically to the hanger segments. In other cases, for example, in the configuration shown in FIG. 4, hangers 222 do provide electrical connection to bars 304A and 306.

The hanger segments 230A, 230B are provided in various lengths as required to obtain the various systems described above, and they are preferably made in the shape of rods of a stiff but somewhat springy material having shape memory such as a phosphor/bronze alloy. Preferably except where an electrical contact is required, the rods are covered or painted with a thin electrically insulating material.

The hangers can be installed by separating the two segments 230A, 230B, passing the ends of the respective bars 302, 304 . . . between the segments, then lowering or raising the bars toward the respective bases 232 and then snapping the bases onto the bars into the configurations shown in FIGS. 9F and 9G.

As discussed above, and illustrated in more detail below, in some instances, the power bars extend perpendicularly to each other. For example, in FIG. 4, bars 302 and 304 are perpendicular to each other. These bars are interconnected using a hanger 222 shown in FIGS. 9H-9J. This hanger 222 has two segments 272A, 272B and a base 232 similar to the base 232 in FIGS. 9A-9G. However, at the bottom hanger 222 is provided with a different base 274. This base 274 is formed with two side wings 274A, 274B and a center wall 274C. Clips 276, 278 are provided on the center wall 274C and are connected electrically with segments 272A, 272B, respectively as show in FIG. 9J. The center wall 274C is made with two holes 280A, 280B with the lower ends of segments 272A, 272B extending into the holes and being secured to the base 222. The base 270 is sized and shaped to engage and support the power bar segments 304A, 304B of a bar 304A with the segments 272A, 272B providing power to these power bar segments. The base 232 engages the segments of the bar 302 in the manner discussed above.

Figure 9A:
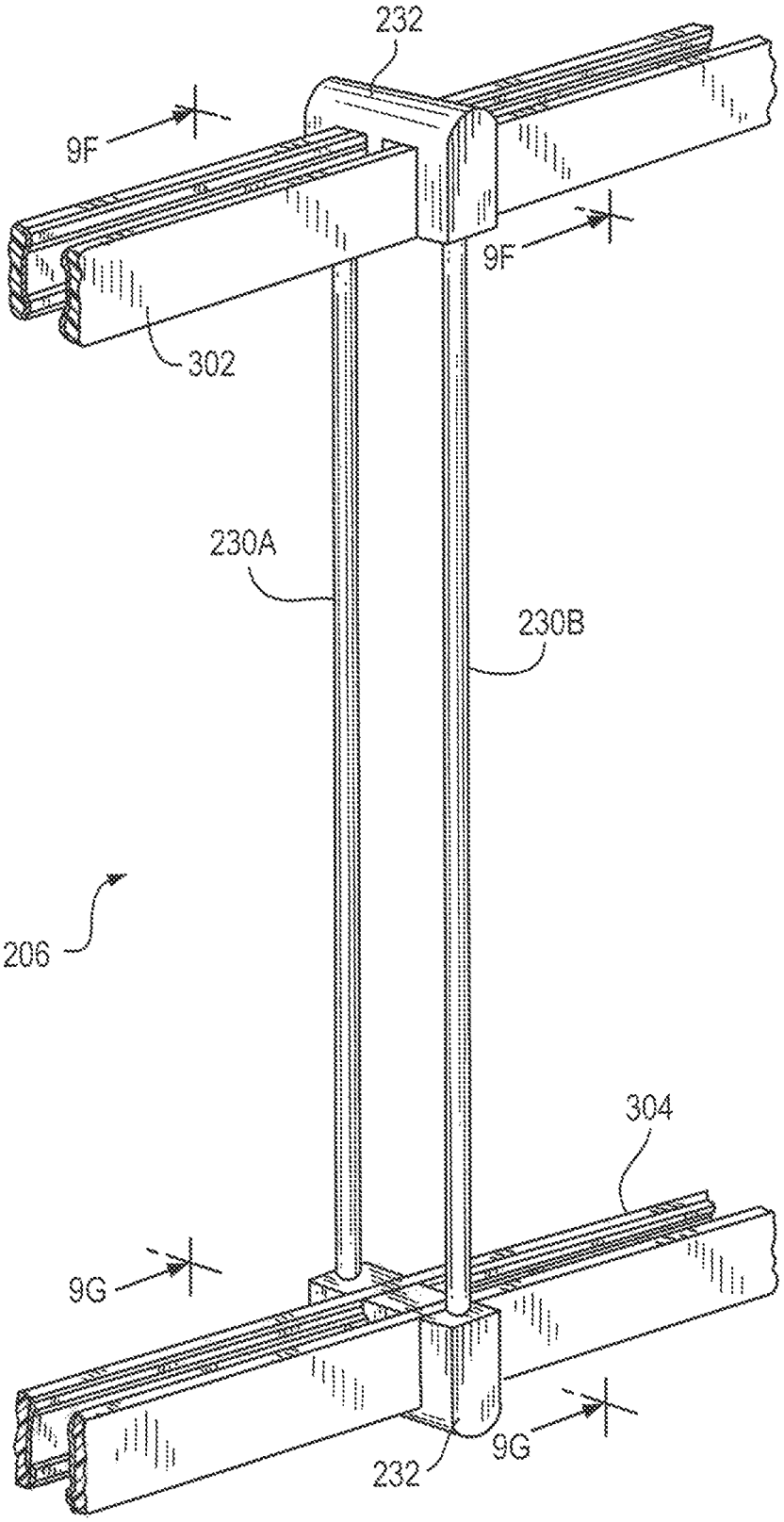
Figure 9C:
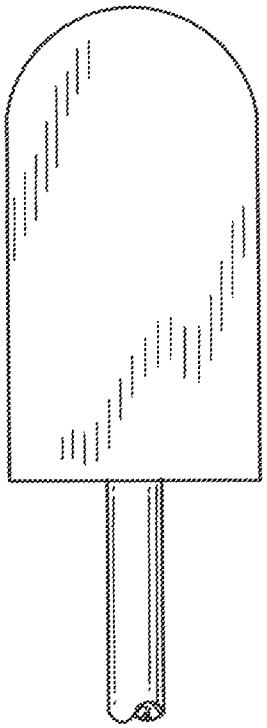
Figure 9B:
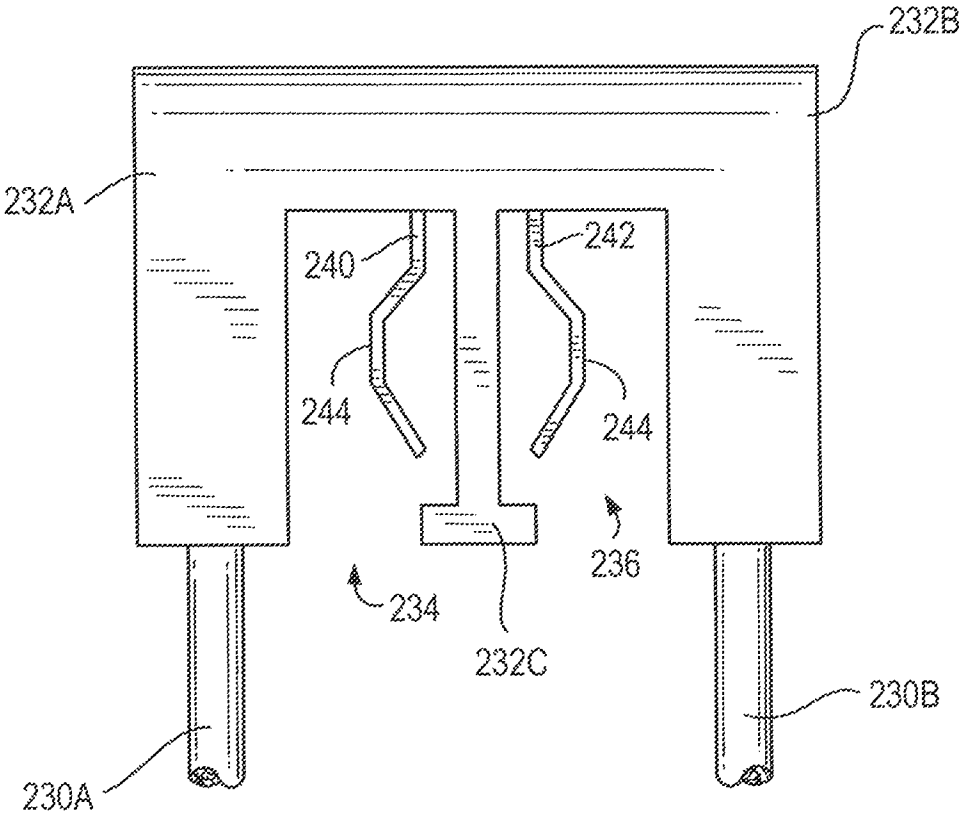
Figure 9H:
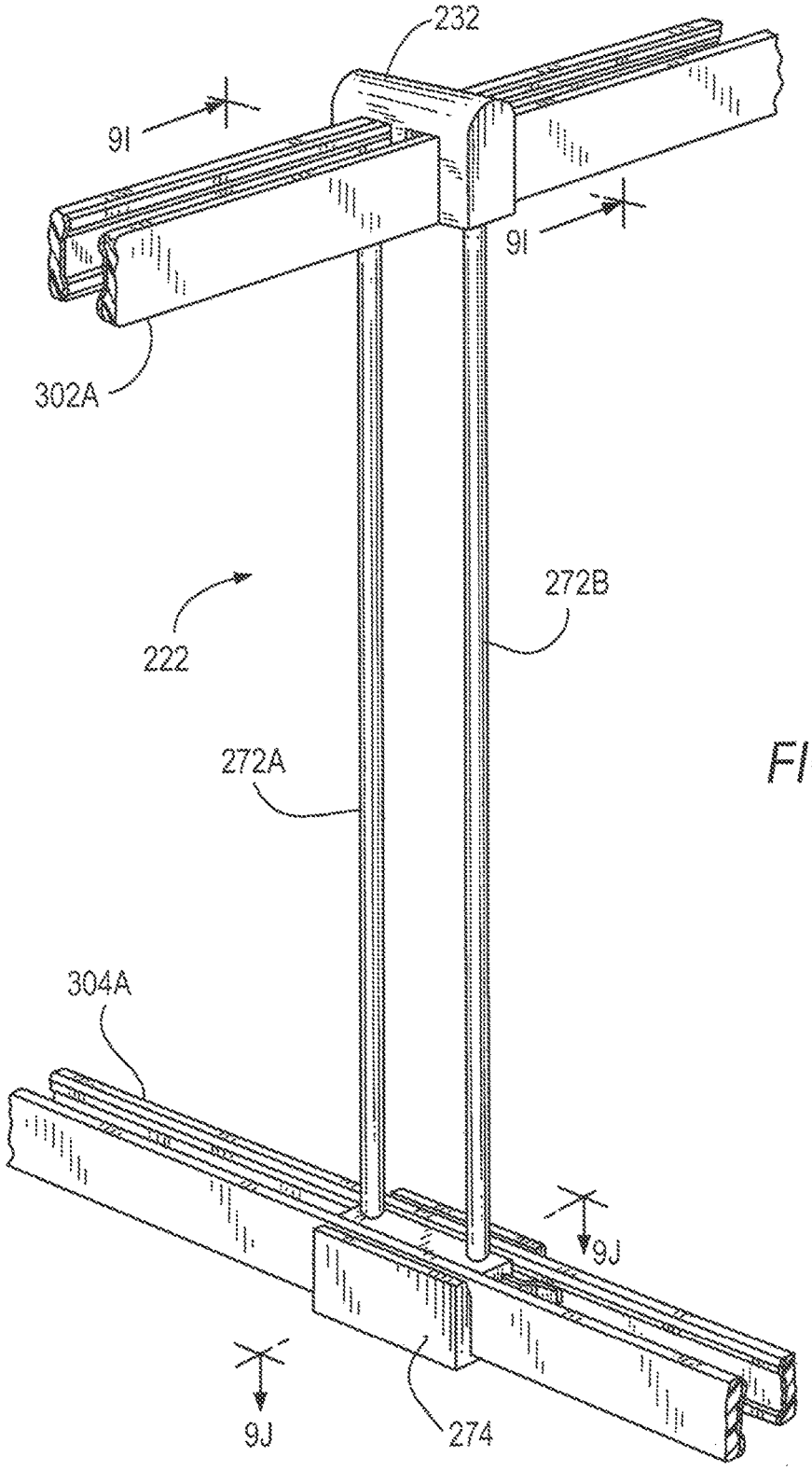
Figure 9I:
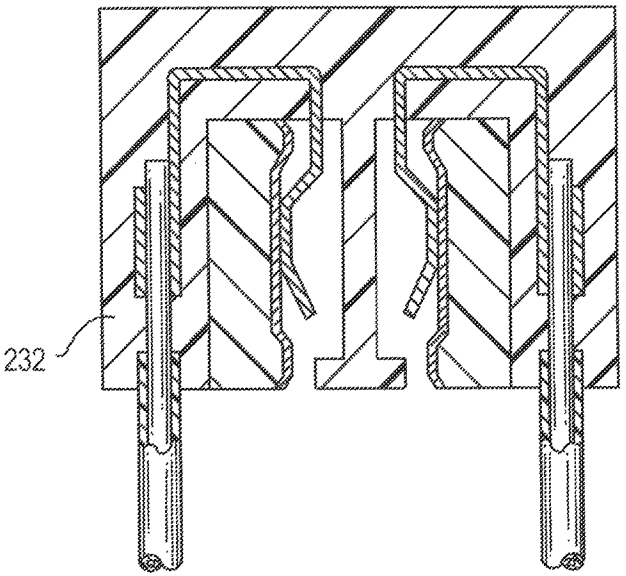
Figure 9J:
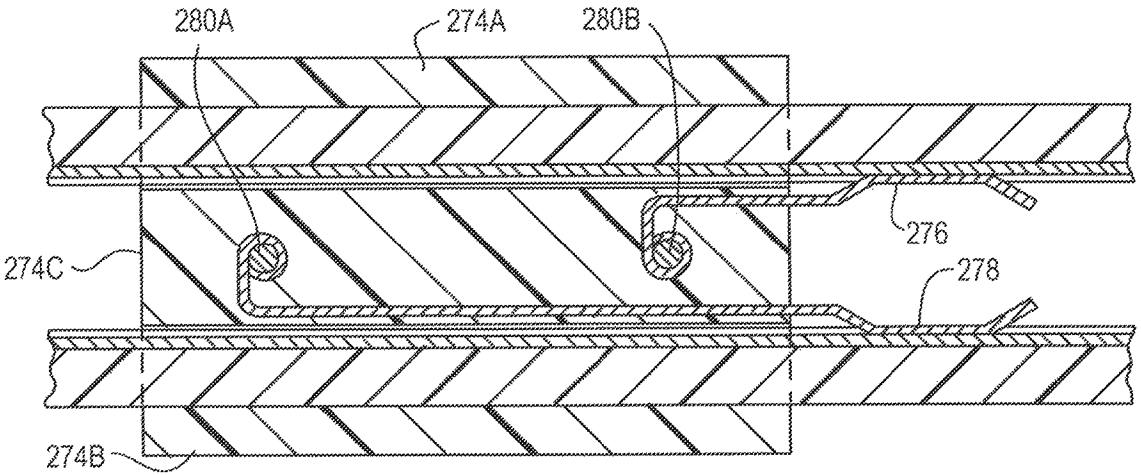
Figure 10:
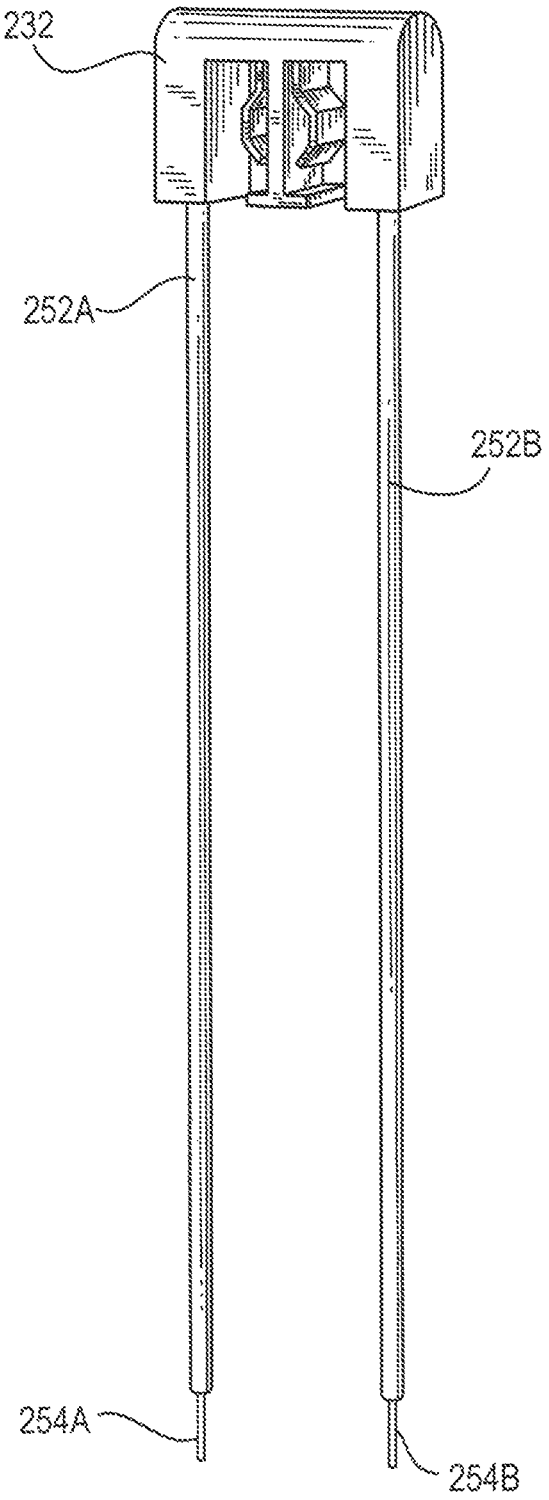
FIG. 10 shows a front view of a hanger used for connecting a bar to a pendant or a canopy in the embodiments of FIGS. 1-6.

In addition to the bar hangers, other types of hangers are used in the system as well. FIG. 10 shows a side view of a hanger having a base 232 and two segments 252A, 252B. The difference between this hanger and the hanger in FIG. 9A is that the ends of segments 252A, 252B are straight bare ends of the conductive rods. This bare ends are then inserted into the ferrules 130 as shown in FIG. 8D. (Of course, for this use, the hanger is turned upside down). Alternatively, the hanger is used a pendant cluster such as cluster 410 in FIG. 4 or other pendants.

Figure 11:
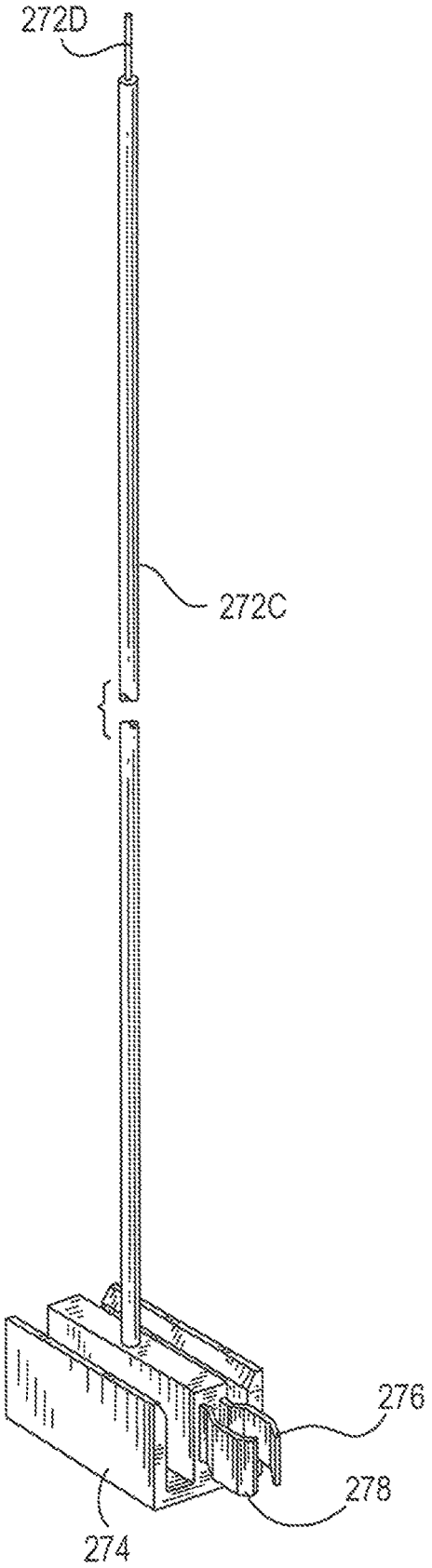
FIG. 11 shows an isometric view of a hanger with a single rod for the embodiment of FIG. 4.

FIG. 11 shows a single rod hanger 214. This hanger 214 includes a base 274A similar to base 274 shown in FIGS. 9H, 9J. The base 274A has two clips 276, 278. When the base 274 is mounted on a bar (such as bar 302A), the clips 276, 278 engage the rail within the bar 302A as discussed above. However only one of the clips (say clip 276) is connected to rod 272C. The free end 272D of the rod 272C is attached to the ferrule of a canopy. Two such hangers 214 are used to support bar 302A (as seen in FIG. 4), with each of the hangers feeding power to one of the rails of the bar.

Figure 12A:
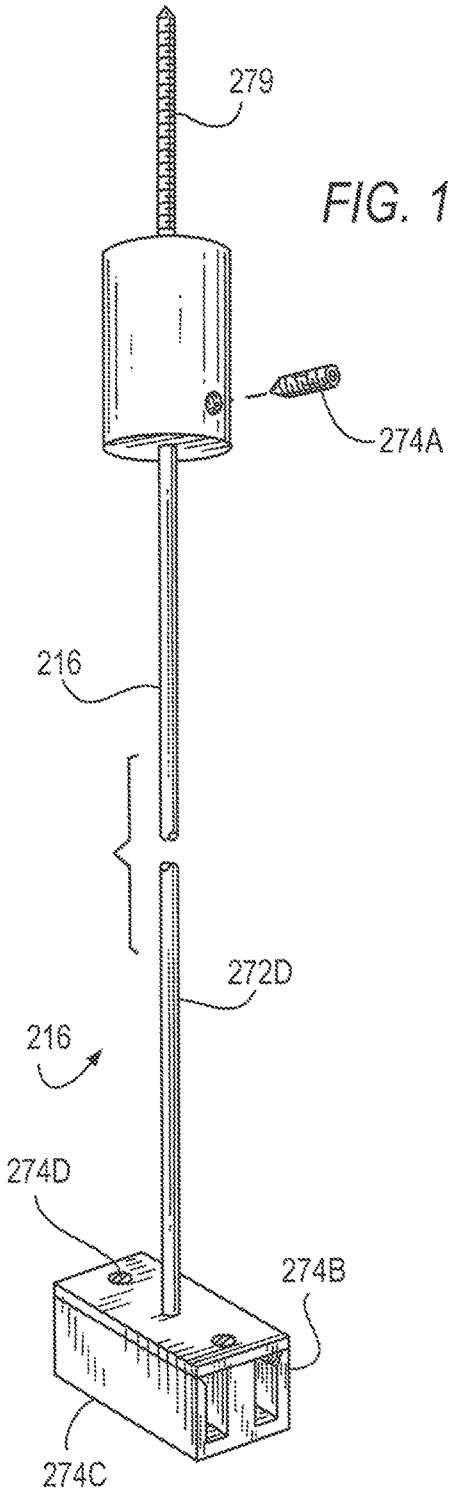
FIGS. 12A-12C show views of a non-conductive hanger with a single rod for the embodiment of FIG. 4.
Figure 12C:
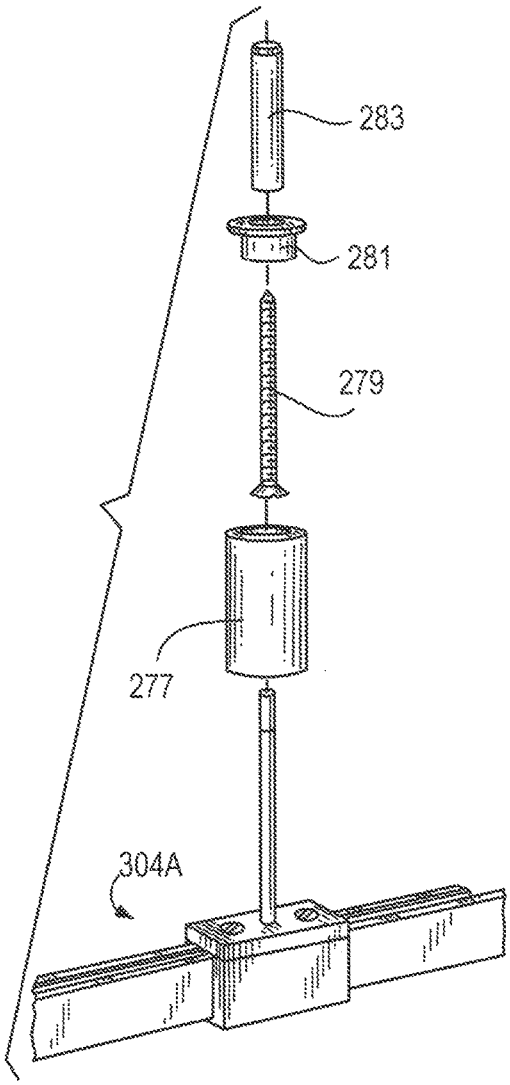
Figure 12B:
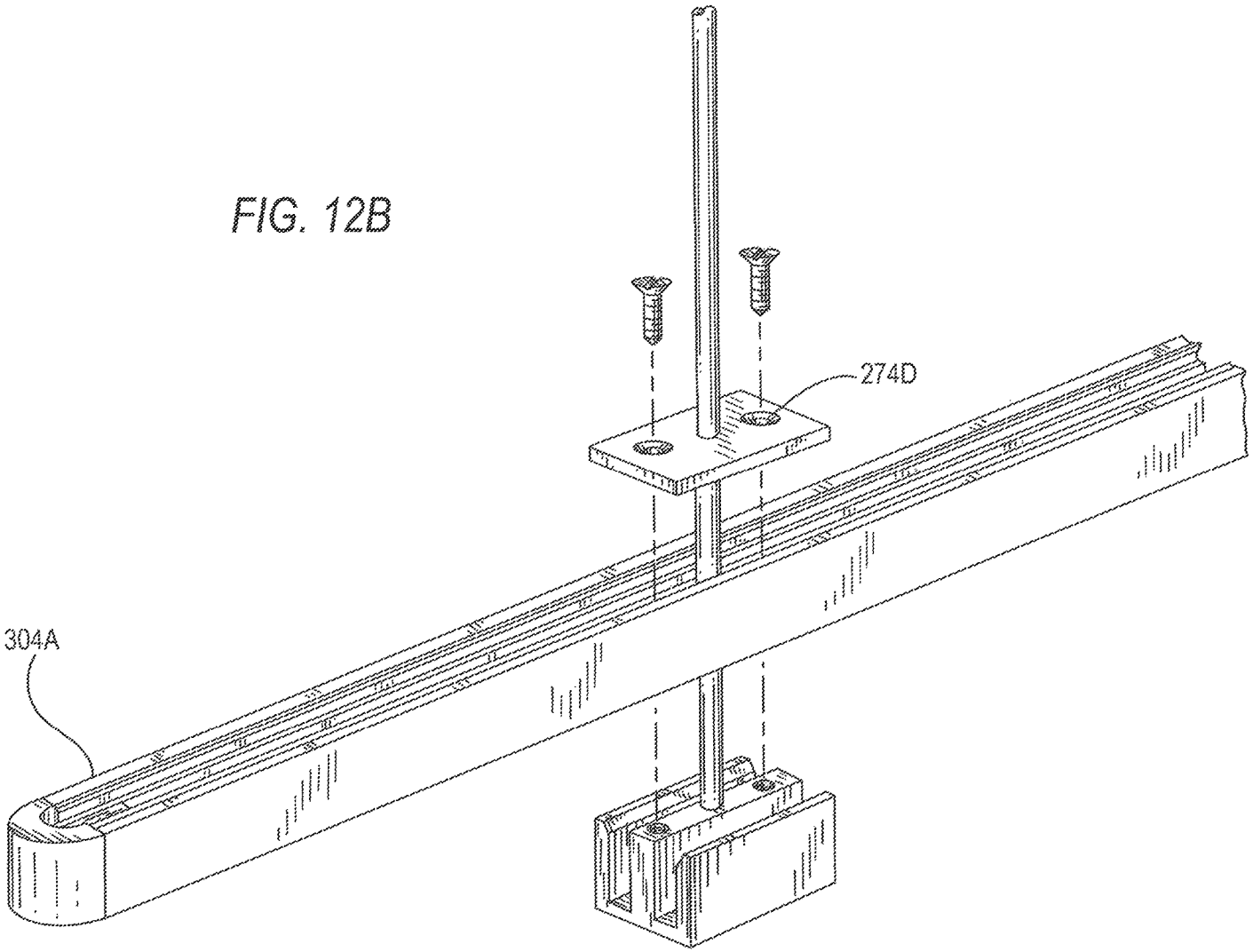

FIGS. 12A-12C show a nonconductive hanger 216 used for supporting a bar, such as bar 304A in FIG. 4 from a ceiling. This hanger 216 provides only support and therefore it can have an elongated member 272D which may but need not be identical to the rod 272C in FIG. 11. The member 272D ends in a base 274B that is similar to the base 274 but need not have any clips since there is no need to connect to the rails of the bus 304A. Since there are no clips provided for the base 274B, a cover 274C is attached to the body 274D of the base 274B to insure that the bar does not slip out. The cover 274C is attached to the body 274D by screws 274E or other conventional means. The other end of the elongated member 272D is attached to a sleeve 277 via a set screw 277A. Preferably, the ferrule 277 is similar to the ferrules of the canopy 100 in that it has a similar sleeve for capturing the end of the member 272D. A small screw (not shown) is used as an attachment means. A large screw 279 or other conventional means may be used to attach the sleeve 277 directly to the ceiling or other architectural surface. Alternatively, the screw 279 is attached to a mounting post 281 and an anchor 283 (FIG. 12C).

FIGS. 13A-13C show a top, plan and isometric view of lamp cluster 410. The cluster 410 includes a distributor 430, and three pairs of connectors 432 connecting the distributor 430 to three pendants 402A, 402B, 402C. The pendants can have the same or different shapes. Importantly, the distributor has to top holes 434, 436. The ends of the rods shown in FIG. 9 are inserted into the holes 434, 436 and then set screws on the sides of the distributor, such as at 438 are tightened thereby attaching and mechanically securing the pendant cluster 410 to the hanger. The hanger and the cluster can now be hanged from a bar 300.

Figure 14A:
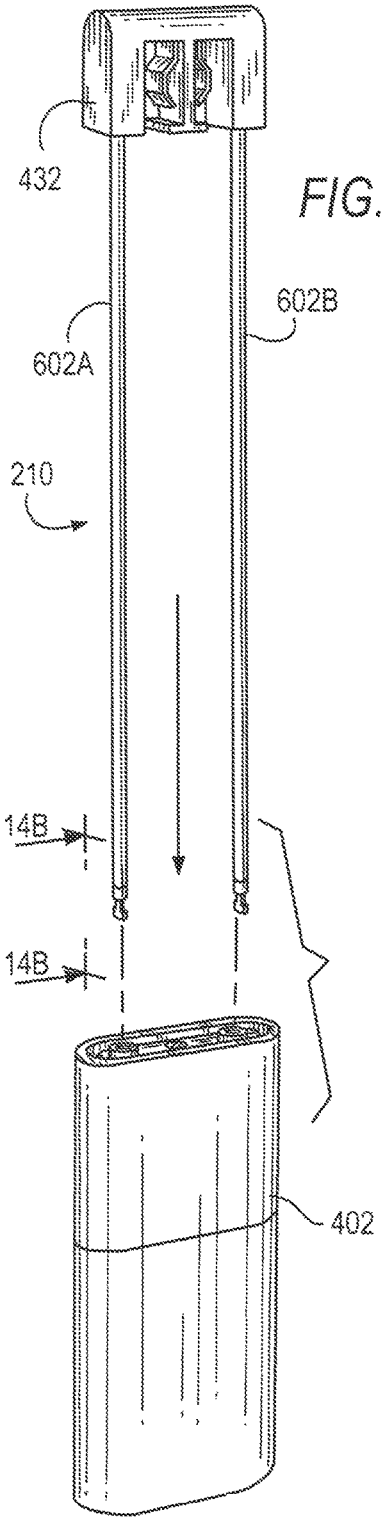
FIGS. 14A-14P show details of a bayonet-type hanger and a pendant that is mounted using a twisting of the hanger and is used in the embodiment of FIG. 1.
Figure 14B:
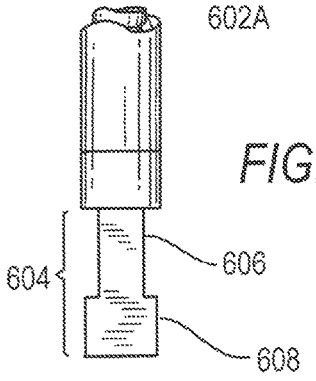
Figure 14P:
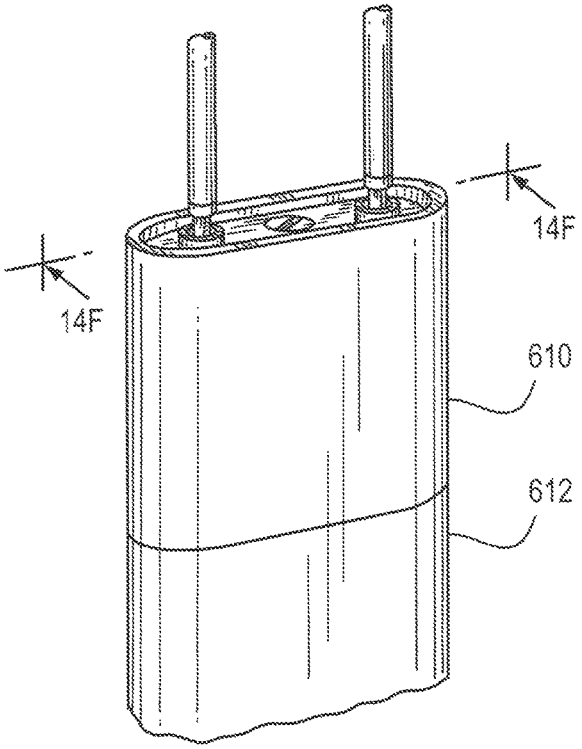

Other structures may be used for attaching pendants to the hangers. One such structure is shown in FIGS. 14A-14O. FIG. 14A shows an orthogonal view of hanger 210 being inserted into pendant 402. As shown in FIGS. 14A, 14B 14C and 14D, the hanger 210 includes two vertical segments 602A, 602B joined by standard base 232. The segment 602A is terminated at the bottom with a connecting spade 604 that has a generally flat, rectangular cross section (as seen in FIG. 14D) of thickness t1. Spade 604 includes a narrow shank 606 having a height h1 and a generally square tip 608 having a width w1. Segment 602B has the same shape as segment 602A and the two spades 604 are normally aligned in parallel to each other and perpendicular to the plane formed by the two parallel segments 602A, 602B, as seen in FIG. 14A.

Pendant 410 is formed with an upper and a lower section 610, 612 (see FIG. 14L). The upper section 610 contains a light engine (not shown) that is powered by the 24 vac source provided by the segments 602A, 602B and generates appropriate power to light generators (such as LEDs—not shown) disposed in the lower section 612. The walls of the lower section are translucent or transparent to allow the light from the light sources to be projected outwardly and provide space illumination. Various pendants may have sections of different shapes and sizes. In one embodiment, the upper section 610 includes a cavity 620 with two holes 622, 624.

The cavity 620 holds two contacts 630, 640 (see FIGS. 14E, 14F). Each contact is connected to the light engine (not shown). Contact 630 is formed with two facing blades having flat portions 632, 634. The distance between the blade portions 632, 634 is t2 which is preferably equal or slightly larger than t1 but smaller than w1 defining respective aperture 633 therebetween. Contact 640 has two similar blades with flat portions 642, 644 spaced to define an aperture 643 therebetweeen. The blade portions 632, 634, 642, 644 have a height h2 that is slightly smaller than height h1.

Figure 14G:
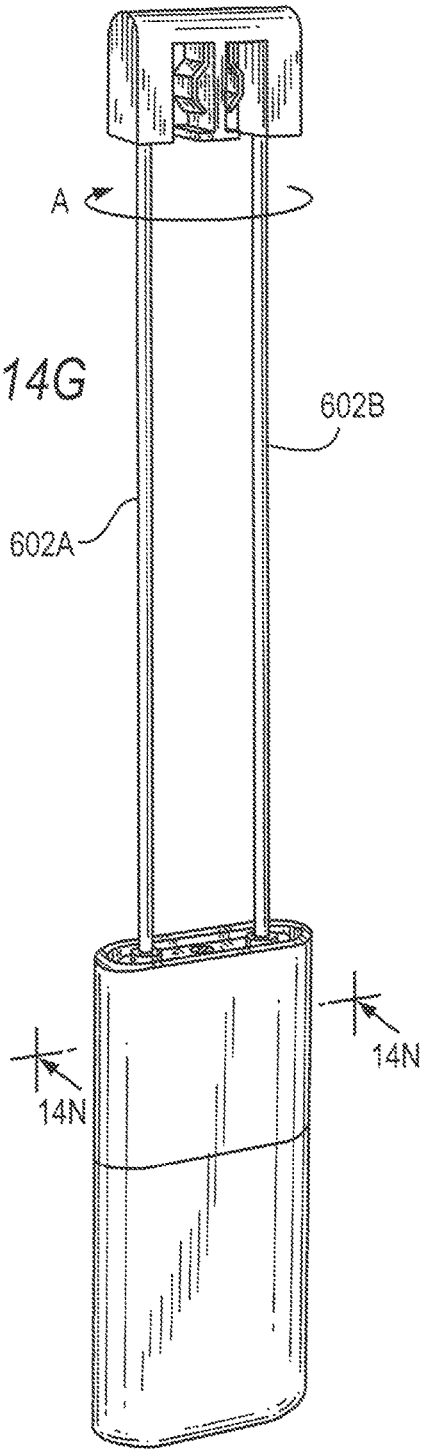

The pendant 410 is attached to the hanger 210 as follows. First, the hanger 210 is positioned on top of pendant 410 with the tips 608 of spades 604 inserted into holes 622, 624 as seen in FIG. 14A, 14G. In this orientation, the spades 604 come into contact with the top of respective blades 630, 640, as shown in FIG. 14H and stop because they can go no further because the apertures 633, 643 have profiles that are at an angle (or more particularly, are perpendicular) to spades 604.

Figure 14M:
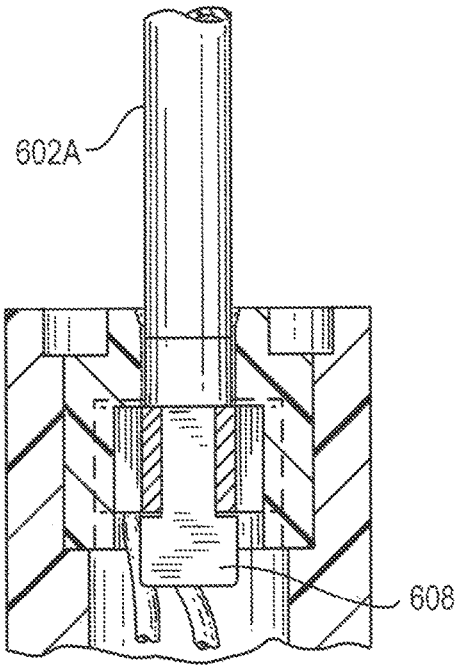
Figure 14I:
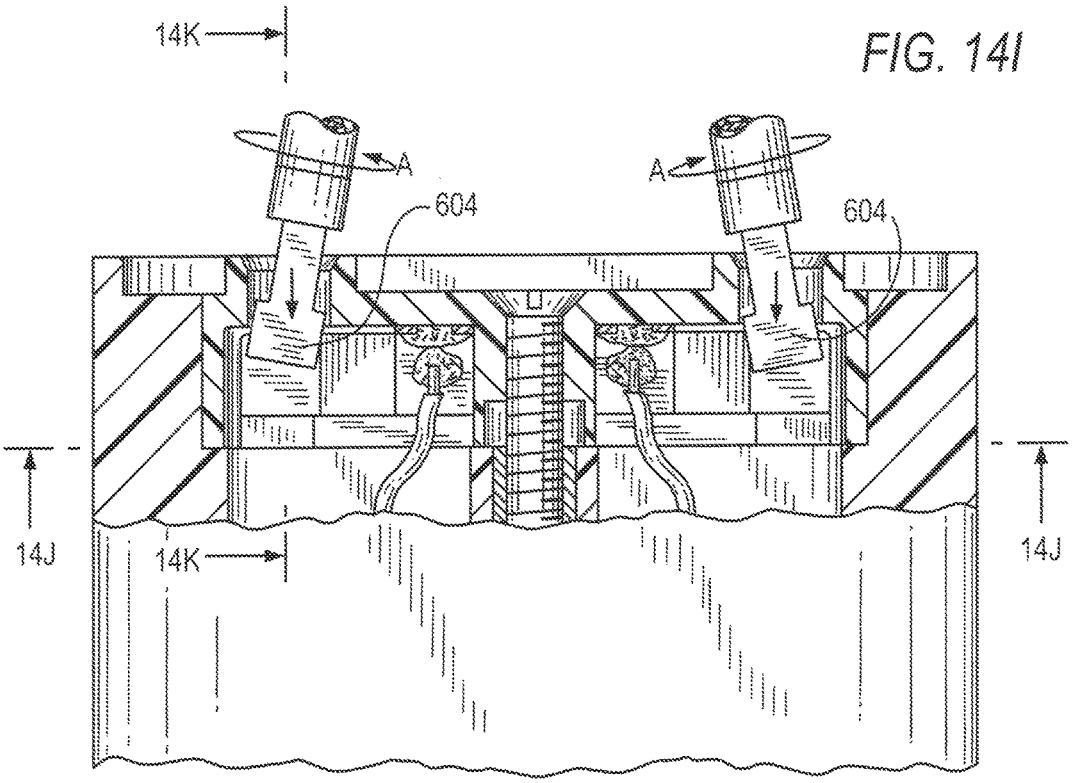
Figure 14J:
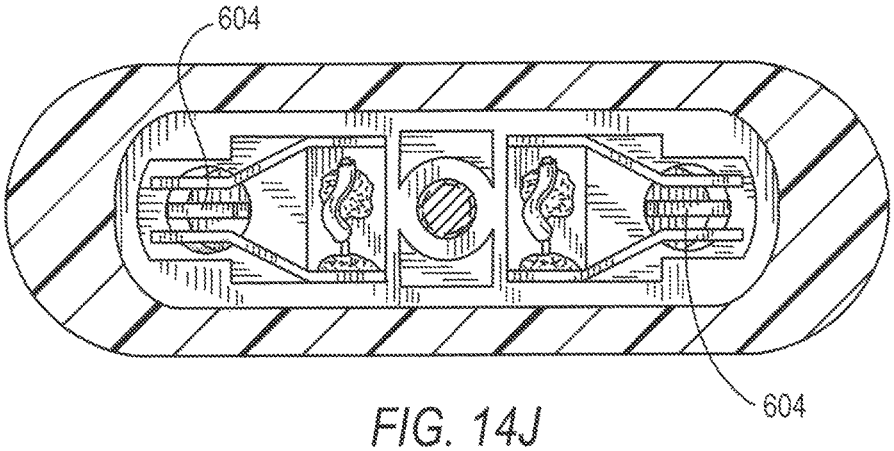

Next, the pendant 610 and top of the hanger 210 is rotated in direction A by a quarter turn (90 degrees). This rotation causes the spades 604 to turn by the same angle so that they are now in parallel with the blade sections 632, 634, or 642,644 respectively, as seen in FIGS. 141 and 14J. At this point, the hanger 210 can be and is pushed further downward so that the spades 604 enter into cavity 620 and through the apertures 633, 643 between the blades. This motion downward can continue until the tips 608 pass the blade sections 632, 634, 642, 644 (FIG. 14K).

Now the hanger 210 is released and the spring action of the two segments 602A, 602B cause the top of the hanger 210 to rotate back in direction B (FIG. 14L) toward its natural or rest configuration. This action causes the spades 604 to rotate as well. As this action is completed, the tips 608 become trapped under the blade sections (see FIGS. 14M-14O). In this manner the hanger 210 and pendant 410 become interlocked. The hanger 210 and pendant 410 can be attached to any bus 300 as required. If necessary, the pendant 410 can be separated from the hanger 210 by twisting it by a quarter turn and reversing the sequence discussed above.

As discussed above, and illustrated in the drawings, the various components or elements described above can be combined into numerous different kinds of configurations. The figures show some systems that include several subsystems that are attached so that they can be extend in three dimensions, to create a linear or circular configurations, or combinations thereof. Moreover, while the systems discussed above are all suspended from a ceiling, other systems are shown and described (together with any special components, if any) that are attached to vertical walls—e.g. sconce-type systems.

Electrically, all these systems have one or more canopies, buses, and hangers that provide a power supply for the canopies. As discussed above, preferably power within the system is distributed at 24 vac to the individual pendants. Light engines within the pendants the use this source to generate light via LEDs or other similar efficient, long life light elements. The systems do not use any conventional bulbs that need replacement. It is presently estimated that the linear distance between a canopy and the furthest pendant can be up to about 30 feet. For larger systems, it is advisable to use two or more canopies. As indicated above, for two or more source-systems, the bars can be interconnected mechanically but isolated electrically as needed. As discussed above, in conjunction with FIG. 3, one bar of a system, for example bar 306 can have two sections 306A, 306B that are electrically insulated from each other with the rails of each section being fed and electrically connected to a different canopy 100.

In this manner, the modular presented herein can be used to make systems having different configurations. Because the hangers can be attached easily in the field to the canopies, the bars and the pendants, each system can be assembled very quickly and efficiently using the various components described above. Moreover, many different kinds of pendants can be used with the system. As long as each pendant is capable of being connected to any of the hangers described above, it can be incorporated into a system without any changes to any of its other components.

Obviously numerous modifications may be made to the invention without departing from its scope as defined in the appended claims.

What is claimed is:

1. A method of assembling features of a lighting system, said lighting system including at least one rod terminating in a rod end including a spade with a body and a shank narrower than said body and a pendant including a pendant body having a pair of blades separated by a distance smaller than the width of said body of said rod and having a top surface having an opening leading to a cavity, said opening having a cross-sectional dimension at least equal to a width of said body of said rod, said method comprising the steps of:

inserting said rod end into said opening until said rod end reaches said blades;

twisting a first time said rod about a longitudinal axis until said spade is aligned with said blades;

pushing said rod end into said cavity between said blades until said spade passes said blades; and twisting said rod a second time about said longitudinal axis until said spade is not aligned with said blades causing said blades to trap said spade in said cavity.

2. The method of claim 1, wherein said system includes two parallel rods, each having identical rod ends, said pendant includes two identical openings and two pairs of blades, and said method further includes the steps of inserting said rod ends simultaneously and twisting said rods said first time and said second time to cause the blades to capture the rod ends of both in said openings of said pendant of said rods.

3. The method of claim 2, wherein said rods are attached to a head and said twisting steps include twisting said head.

4. The method of claim 1, wherein said step of twisting a first time includes twisting the rod in a first direction and wherein said step of twisting a second time includes twisting the rod in a second direction, opposite said first direction.

* * * * *